US011304479B2

(12) United States Patent
Houng et al.

(10) Patent No.: US 11,304,479 B2
(45) Date of Patent: Apr. 19, 2022

(54) FOOTWEAR WITH LACELESS FASTENING SYSTEM

(71) Applicant: NIKE, Inc., Beaverton, OR (US)

(72) Inventors: Derek Houng, Portland, OR (US); Jason G. Petrie, Portland, OR (US); Miaochang Zadnik, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 715 days.

(21) Appl. No.: 15/839,242

(22) Filed: Dec. 12, 2017

(65) Prior Publication Data

US 2018/0242692 A1 Aug. 30, 2018

Related U.S. Application Data

(60) Provisional application No. 62/464,571, filed on Feb. 28, 2017.

(51) Int. Cl.
*A43C 11/00* (2006.01)
*A43C 11/14* (2006.01)
(Continued)

(52) U.S. Cl.
CPC ..... *A43C 11/006* (2013.01); *A43C 11/008* (2013.01); *A43C 11/14* (2013.01);
(Continued)

(58) Field of Classification Search
CPC ..... A43C 11/006; A43C 11/008; A43C 11/14; A43C 11/1493; A43C 11/00;
(Continued)

(56) References Cited

U.S. PATENT DOCUMENTS 4,497 A 5/1846 Vetter
75,048 A 3/1868 Perley
(Continued)

FOREIGN PATENT DOCUMENTS

CA 1141535 A 2/1983
CN 87209219 U 5/1988
(Continued)

OTHER PUBLICATIONS

Always Believe, Nike News, https://news.nike.com/news/lebron_solider_10_id; Jun. 19, 2016.
(Continued)

*Primary Examiner* — Timothy K Trieu
*Assistant Examiner* — Dakota Marin
(74) *Attorney, Agent, or Firm* — Quinn IP Law

(57) ABSTRACT

An article of footwear includes an upper that has a body extending over at least a portion of a first side and a second side of the upper. A laceless fastening system includes a strap having an anchored end fixed at the second side and a distal end selectively remote from the upper. A first fastener is fixed to an outer surface of the body on the first side. The first fastener is less elastic than the body. A segmented second fastener is fixed to the inner side of the strap. The segmented second fastener includes a proximal segment and a distal segment closer to the distal end of the strap than the proximal segment and spaced apart from the proximal segment along the strap by an exposed portion of the strap. The segmented second fastener is less elastic than the strap.

19 Claims, 10 Drawing Sheets

(51) Int. Cl.

| | |
|---|---|
| *A43C 1/00* | (2006.01) |
| *A43C 11/08* | (2006.01) |
| *A43C 1/04* | (2006.01) |
| *A43C 1/02* | (2006.01) |
| *A43C 1/06* | (2006.01) |
| *A43C 11/22* | (2006.01) |

(52) U.S. Cl.
CPC ..... *A43C 11/1493* (2013.01); *A43C 1/00* (2013.01); *A43C 1/003* (2013.01); *A43C 1/006* (2013.01); *A43C 1/02* (2013.01); *A43C 1/04* (2013.01); *A43C 1/06* (2013.01); *A43C 11/00* (2013.01); *A43C 11/002* (2013.01); *A43C 11/004* (2013.01); *A43C 11/08* (2013.01); *A43C 11/22* (2013.01)

(58) Field of Classification Search
CPC ..... A43C 11/002; A43C 11/004; A43C 11/08; A43C 11/22; A43C 1/00; A43C 1/003; A43C 1/006; A43C 1/02; A43C 1/04; A43C 1/06
USPC ..... 36/50.1, 51; 24/442
See application file for complete search history.

(56) References Cited

U.S. PATENT DOCUMENTS 171,301 A 12/1875 McKee
417,460 A 12/1889 Wurtele
474,574 A 5/1892 Bruzon
503,588 A 8/1893 Elterich et al.
537,627 A 4/1895 Bixby et al.
558,937 A 4/1896 Edmonds
808,948 A 1/1906 Roberts
827,330 A 7/1906 Tillson
863,549 A 8/1907 Metz
913,012 A * 2/1909 Jackson ..... A43B 23/047 36/51
955,337 A 4/1910 Lawlor
1,081,678 A 12/1913 Langerak
1,494,236 A 5/1924 Greathouse
1,585,049 A 5/1926 Skoglund
1,603,144 A 10/1926 Nichols
1,649,173 A * 11/1927 McDonough ..... A43B 7/1495 36/170
1,686,175 A 10/1928 Read
1,700,569 A * 1/1929 Hillery ..... A43B 7/1495 36/176
1,812,622 A 6/1931 Costello
1,894,939 A * 1/1933 Brown ..... A43B 7/1495 36/170
1,976,819 A * 10/1934 Weiler ..... A43B 7/1495 36/166
2,069,752 A 2/1937 Dorr
2,252,315 A 8/1941 Doree
2,302,596 A 11/1942 Bigio
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,349,505 A 10/1967 Lopez
3,400,474 A 9/1968 Tendler
3,436,842 A 4/1969 Sachs
3,626,610 A * 12/1971 Dassler ..... A43B 5/06 36/50.1
3,913,243 A * 10/1975 Arnold ..... A43B 5/185 36/135
4,079,527 A * 3/1978 Antonious ..... A43C 11/008 36/50.1
4,095,356 A 6/1978 Robran et al.
4,136,468 A 1/1979 Munschy
4,178,703 A * 12/1979 Pols ..... A61F 5/0195 36/105
4,296,558 A * 10/1981 Antonious ..... A43C 11/008 36/102
4,309,832 A 1/1982 Hunt
4,414,761 A 11/1983 Mahood
4,451,995 A * 6/1984 Antonious ..... A43B 23/047 36/51
4,486,965 A * 12/1984 Friton ..... A43C 11/1493 36/50.1
4,489,509 A 12/1984 Libit
4,507,879 A 4/1985 Dassler
4,559,724 A 12/1985 Norton
4,562,651 A 1/1986 Frederick et al.
4,573,457 A 3/1986 Parks
4,594,798 A 6/1986 Autry et al.
4,599,811 A * 7/1986 Rousseau ..... A43B 3/106 36/105
4,615,126 A 10/1986 Mathews
4,640,025 A * 2/1987 DeRenzo ..... A43C 11/1493 36/114
4,649,656 A 3/1987 Cox et al.
4,665,634 A 5/1987 Diaz
4,773,170 A * 9/1988 Moore ..... A43B 21/32 36/11.5
4,776,111 A 10/1988 Crowley
4,860,464 A * 8/1989 Misevich ..... A43B 7/1495 36/114
4,944,099 A 7/1990 Davis
4,955,150 A * 9/1990 Fagan ..... A43B 1/0072 36/136
4,959,914 A 10/1990 Hilgarth
4,972,613 A 11/1990 Loveder
5,054,216 A 10/1991 Lin
5,074,059 A * 12/1991 Melcher ..... A43C 13/14 36/58.5
5,090,140 A 2/1992 Sessa
5,127,170 A 7/1992 Messina
5,152,082 A 10/1992 Culpepper
5,181,331 A 1/1993 Berger
5,184,410 A 2/1993 Hamilton
5,222,313 A 6/1993 Dowdy et al.
5,255,452 A * 10/1993 Jackson ..... B64G 6/00 36/1
5,279,051 A 1/1994 Whatley
5,282,327 A 2/1994 Ogle
5,341,583 A 8/1994 Hallenbeck
5,345,698 A 9/1994 Billet et al.
5,367,794 A * 11/1994 Adelstein ..... A43B 5/185 36/135
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,682,687 A 11/1997 Arai
5,778,565 A * 7/1998 Holt ..... A43B 1/0081 36/101
5,794,360 A * 8/1998 Bell ..... A43C 11/1493 24/306
5,813,144 A 9/1998 Prengler
5,819,439 A * 10/1998 Sanchez ..... A43C 11/14 36/89
5,842,292 A 12/1998 Siesel
5,884,420 A 3/1999 Donnadieu
5,946,737 A * 9/1999 Fleege ..... A41D 13/06 2/16
5,983,530 A 11/1999 Chou
5,997,027 A 12/1999 Jungkind

(56) References Cited

U.S. PATENT DOCUMENTS 6,000,148 A 12/1999 Cretinon
6,189,239 B1 2/2001 Gasparovic et al.
6,212,798 B1 * 4/2001 Koenig ..... A43B 7/00 36/11.5
6,290,559 B1 9/2001 Scott
6,298,582 B1 10/2001 Friton et al.
6,378,230 B1 4/2002 Rotem et al.
6,438,872 B1 8/2002 Chil et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,817,116 B2 11/2004 Chil et al.
6,832,442 B2 * 12/2004 Lewis ..... A43B 1/0081 36/7.1 R
6,883,254 B2 4/2005 Miller et al.
6,925,732 B1 8/2005 Clarke
6,938,361 B2 9/2005 Su
6,957,504 B2 10/2005 Morris
6,962,011 B2 * 11/2005 Drennan ..... A43B 13/181 36/110
6,964,119 B2 11/2005 Weaver, III
6,996,922 B2 * 2/2006 Ryoo ..... A43B 7/1495 36/27
7,055,268 B2 6/2006 Ha
7,059,069 B2 6/2006 Raluy et al.
7,080,468 B2 7/2006 Miller et al.
7,101,604 B1 9/2006 Minges
7,103,994 B2 9/2006 Johnson
7,127,837 B2 10/2006 Ito
7,168,190 B1 1/2007 Gillespie
7,178,270 B2 2/2007 Hurd et al.
7,188,438 B1 3/2007 Bowen
7,200,957 B2 * 4/2007 Hubbard ..... A43B 5/00 36/50.1
7,225,563 B2 6/2007 Chen et al.
7,284,341 B2 10/2007 Moseley
7,287,294 B2 10/2007 Miller et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,823,299 B1 11/2010 Brigham
7,874,997 B2 * 1/2011 Jaccard ..... A61F 5/0118 602/27
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
7,984,571 B2 7/2011 Pellegrini
8,006,410 B2 8/2011 Romboli et al.
8,020,317 B1 9/2011 Sokolowski
D648,512 S 11/2011 Schlageter et al.
8,065,819 B2 11/2011 Kaufman
8,156,664 B2 * 4/2012 Shepherd ..... A43B 1/0081 36/114
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,365,443 B2 2/2013 Huynh
D680,719 S 4/2013 Dardinski
8,468,721 B2 6/2013 Sokolowski
8,468,723 B2 6/2013 Malka-Harari
8,499,474 B2 8/2013 Kaufman
8,539,698 B1 9/2013 Woodruff
8,549,774 B2 10/2013 Meschter et al.
8,578,632 B2 11/2013 Bell et al.
8,627,582 B2 1/2014 Perenich
8,627,583 B2 1/2014 Perenich
8,635,791 B2 1/2014 Baudouin et al.
8,656,613 B2 2/2014 Stockbridge et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,044,063 B2 6/2015 Loverin et al.
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,210,966 B2 12/2015 Bell et al.
9,226,543 B2 1/2016 Campbell
9,254,018 B2 2/2016 Bliss
9,265,305 B2 2/2016 Hatfield et al.
9,271,539 B2 * 3/2016 Karandonis ..... A43B 3/06
9,271,544 B2 3/2016 Peyton et al.
9,301,570 B2 4/2016 Hwang
9,314,055 B2 4/2016 Moran
9,314,067 B2 4/2016 Bock
9,363,980 B2 6/2016 Lander
9,392,843 B2 7/2016 Callahan et al.
9,392,844 B1 7/2016 Burrell
9,398,785 B2 7/2016 Horacek
9,398,786 B2 7/2016 Gavrieli et al.
9,414,640 B2 8/2016 Nichols
9,433,256 B2 9/2016 Callahan et al.
9,445,644 B2 9/2016 Cressman et al.
9,474,330 B2 10/2016 Panian et al.
9,480,299 B2 11/2016 Dinndorf et al.
9,609,908 B2 4/2017 Bell et al.
9,675,132 B2 6/2017 Marshall
9,770,065 B2 9/2017 Bell et al.
9,820,527 B2 11/2017 Pratt et al.
9,839,261 B2 12/2017 Hatfield et al.
9,854,875 B2 1/2018 Hatfield et al.
9,877,542 B2 1/2018 Pratt
9,888,743 B2 2/2018 Bell et al.
9,949,533 B2 4/2018 Feinstein
10,159,310 B2 12/2018 Sullivan
2002/0020078 A1 * 2/2002 Bressoux ..... A43B 5/049 36/30 R
2002/0133974 A1 * 9/2002 Bartolini ..... A43C 15/06 36/7.7
2002/0144434 A1 10/2002 Farys et al.
2002/0174568 A1 11/2002 Neiley
2003/0200680 A1 10/2003 Chang
2004/0111921 A1 6/2004 Lenormand
2004/0118018 A1 * 6/2004 Dua ..... A43B 1/04 36/45
2004/0231196 A1 * 11/2004 Kassai ..... A43B 3/30 36/90
2005/0039348 A1 2/2005 Raluy et al.
2005/0060913 A1 3/2005 Chil et al.
2005/0066548 A1 3/2005 Chil et al.
2005/0284002 A1 12/2005 Aveni
2007/0011917 A1 1/2007 Hayes
2007/0039208 A1 2/2007 Bove et al.
2007/0074425 A1 4/2007 Leong
2007/0175064 A1 * 8/2007 Culton ..... A43B 1/0081 36/7.1 R
2007/0186441 A1 8/2007 Chen
2007/0199211 A1 8/2007 Campbell

(56) References Cited

U.S. PATENT DOCUMENTS

| | | | | |
|---|---|---|---|---|
| 2007/0199213 | A1 | 8/2007 | Campbell et al. | |
| 2007/0209234 | A1 | 9/2007 | Chou | |
| 2008/0000106 | A1 | 1/2008 | Culpepper | |
| 2008/0086911 | A1 | 4/2008 | Labbe | |
| 2008/0141562 | A1 | 6/2008 | Peveto | |
| 2008/0307673 | A1 | 12/2008 | Johnson | |
| 2009/0025260 | A1 | 1/2009 | Nakano | |
| 2010/0313445 | A1* | 12/2010 | Hochdoerffer | A43B 1/0027 36/50.1 |
| 2010/0319216 | A1 | 12/2010 | Grenzke et al. | |
| 2011/0016751 | A1 | 1/2011 | Somerville | |
| 2011/0146106 | A1 | 6/2011 | Kaufman | |
| 2011/0214312 | A1 | 9/2011 | Krikelis | |
| 2011/0247238 | A1 | 10/2011 | Chestnut | |
| 2012/0036738 | A1* | 2/2012 | Willis | A43B 5/185 36/73 |
| 2012/0079746 | A1 | 4/2012 | Ferreira et al. | |
| 2012/0204450 | A1 | 8/2012 | Girbaud | |
| 2012/0317839 | A1 | 12/2012 | Pratt | |
| 2013/0047463 | A1* | 2/2013 | Menezes | A43B 9/12 36/50.1 |
| 2013/0185959 | A1 | 7/2013 | Coleman | |
| 2013/0219747 | A1 | 8/2013 | Lederer | |
| 2013/0318827 | A1 | 12/2013 | Ringholz | |
| 2014/0000131 | A1 | 1/2014 | Meschter et al. | |
| 2014/0013624 | A1 | 1/2014 | Stockbridge et al. | |
| 2014/0096415 | A1 | 4/2014 | Long | |
| 2014/0115925 | A1 | 5/2014 | Hurd et al. | |
| 2014/0173939 | A1 | 6/2014 | Carboy et al. | |
| 2014/0196311 | A1 | 7/2014 | Follet et al. | |
| 2014/0196317 | A1* | 7/2014 | Katz | A43C 11/1493 36/89 |
| 2014/0250723 | A1 | 9/2014 | Kohatsu | |
| 2014/0259763 | A1* | 9/2014 | Rady | A43B 21/00 36/58.5 |
| 2014/0298687 | A1 | 10/2014 | Flinterman et al. | |
| 2014/0305005 | A1 | 10/2014 | Yeh | |
| 2014/0310992 | A1 | 10/2014 | Shalom et al. | |
| 2014/0360049 | A1 | 12/2014 | Panian et al. | |
| 2015/0000165 | A1 | 1/2015 | Reiff | |
| 2015/0020416 | A1 | 1/2015 | Wiens | |
| 2015/0047223 | A1 | 2/2015 | Flinterman et al. | |
| 2015/0047225 | A1 | 2/2015 | Zavala et al. | |
| 2015/0047227 | A1 | 2/2015 | Fallon et al. | |
| 2015/0096197 | A1 | 4/2015 | Salinas | |
| 2015/0113834 | A1 | 4/2015 | Dojan et al. | |
| 2015/0143720 | A1 | 5/2015 | Avar | |
| 2015/0196095 | A1 | 7/2015 | Chapman | |
| 2015/0216252 | A1 | 8/2015 | Wiens | |
| 2015/0289595 | A1 | 10/2015 | Rushbrook et al. | |
| 2015/0305432 | A1 | 10/2015 | Wiens | |
| 2015/0305442 | A1 | 10/2015 | Ravindran | |
| 2015/0374065 | A1 | 12/2015 | DiFrancisco | |
| 2016/0128429 | A1 | 5/2016 | Hatfield et al. | |
| 2016/0166006 | A1 | 6/2016 | DiFrancisco | |
| 2016/0270484 | A1 | 9/2016 | Zadnik | |
| 2016/0302530 | A1 | 10/2016 | Smith et al. | |
| 2016/0324257 | A1* | 11/2016 | Ko | A43B 7/1495 |
| 2016/0374427 | A1 | 12/2016 | Zahabian | |
| 2017/0042290 | A1 | 2/2017 | Hatfield et al. | |
| 2017/0049190 | A1 | 2/2017 | Maussen | |
| 2017/0099906 | A1 | 4/2017 | Figueroa | |
| 2017/0150773 | A1 | 6/2017 | Beers | |
| 2017/0224055 | A1* | 8/2017 | Hooper | A43C 11/1493 |
| 2017/0265560 | A1 | 9/2017 | Beers et al. | |
| 2017/0360143 | A1 | 12/2017 | Pratt et al. | |
| 2018/0110287 | A1 | 4/2018 | Hopkins et al. | |
| 2018/0110288 | A1 | 4/2018 | Hatfield et al. | |
| 2018/0110289 | A1 | 4/2018 | Owings et al. | |
| 2018/0206588 | A1 | 7/2018 | Pratt et al. | |
| 2018/0213882 | A1 | 8/2018 | Morse | |
| 2018/0213890 | A1 | 8/2018 | Innocente | |
| 2018/0235314 | A1 | 8/2018 | Farage | |
| 2018/0242692 | A1 | 8/2018 | Houng et al. | |
| 2018/0263332 | A1 | 9/2018 | Bruno | |
| 2018/0295942 | A1 | 10/2018 | Drake | |
| 2018/0338562 | A1 | 11/2018 | Hatfield et al. | |
| 2018/0338566 | A1 | 11/2018 | Hatfield et al. | |
| 2019/0000186 | A1 | 1/2019 | Mou et al. | |

FOREIGN PATENT DOCUMENTS

| | | | |
|---|---|---|---|
| CN | 87103983 | A | 12/1988 |
| CN | 2052208 | U | 2/1990 |
| CN | 2161101 | Y | 4/1994 |
| CN | 2262929 | Y | 9/1997 |
| CN | 2268406 | Y | 11/1997 |
| CN | 2275814 | Y | 3/1998 |
| CN | 2281094 | Y | 5/1998 |
| CN | 2384464 | Y | 6/2000 |
| CN | 2438353 | Y | 7/2001 |
| CN | 2456500 | Y | 10/2001 |
| CN | 2482829 | Y | 3/2002 |
| CN | 1403041 | A | 3/2003 |
| CN | 1565297 | A | 1/2005 |
| CN | 2712118 | Y | 7/2005 |
| CN | 1720835 | A | 1/2006 |
| CN | 2783792 | Y | 5/2006 |
| CN | 2819852 | Y | 9/2006 |
| CN | 1278639 | C | 10/2006 |
| CN | 1943463 | A | 4/2007 |
| CN | 2901950 | Y | 5/2007 |
| CN | 201005111 | Y | 1/2008 |
| CN | 201157014 | Y | 12/2008 |
| CN | 201167619 | Y | 12/2008 |
| CN | 101485505 | A | 7/2009 |
| CN | 101518380 | A | 9/2009 |
| CN | 201426430 | Y | 3/2010 |
| CN | 201504620 | U | 6/2010 |
| CN | 101500446 | B | 1/2011 |
| CN | 201743039 | U | 2/2011 |
| CN | 101986920 | A | 3/2011 |
| CN | 201831038 | U | 5/2011 |
| CN | 102159288 | A | 8/2011 |
| CN | 201967803 | U | 9/2011 |
| CN | 102256673 | A | 11/2011 |
| CN | 202211219 | U | 5/2012 |
| CN | 101991227 | B | 8/2012 |
| CN | 102970889 | A | 3/2013 |
| CN | 202819794 | U | 3/2013 |
| CN | 203121188 | U | 8/2013 |
| CN | 203137220 | U | 8/2013 |
| CN | 203841187 | U | 9/2014 |
| CN | 203884822 | U | 10/2014 |
| CN | 203913577 | U | 11/2014 |
| CN | 204070772 | U | 1/2015 |
| CN | 104394729 | A | 3/2015 |
| CN | 102595952 | B | 4/2015 |
| CN | 205040743 | U | 2/2016 |
| CN | 105876979 | A | 8/2016 |
| CN | 205568021 | U | 9/2016 |
| CN | 205611886 | U | 10/2016 |
| CN | 205658453 | U | 10/2016 |
| CN | 106136418 | A | 11/2016 |
| CN | 205671573 | U | 11/2016 |
| CN | 205795015 | U | 12/2016 |
| CN | 206025369 | U | 3/2017 |
| CN | 107692396 | A | 2/2018 |
| CN | 107921318 | A | 4/2018 |
| CN | 207544444 | U | 6/2018 |
| CN | 207949063 | U | 10/2018 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 10208853 | C1 | 6/2003 |
| DE | 10247163 | A1 | 4/2004 |
| DE | 102004005288 | A1 | 8/2005 |
| DE | 102009023689 | A1 | 12/2010 |
| DE | 102013200701 | A1 | 7/2013 |
| DE | 202016001813 | U1 | 6/2017 |
| EP | 0252517 | A2 | 1/1988 |
| EP | 0570621 | A1 | 11/1993 |

(56) References Cited

FOREIGN PATENT DOCUMENTS

| | | | |
|---|---|---|---|
| EP | 0548116 | B1 | 12/1994 |
| EP | 1059044 | A1 | 12/2000 |
| EP | 1593315 | B1 | 5/2008 |
| EP | 1952715 | A1 | 8/2008 |
| EP | 2173208 | B1 | 12/2010 |
| EP | 2277402 | A2 | 1/2011 |
| EP | 2490565 | A1 | 8/2012 |
| EP | 2036449 | B1 | 4/2013 |
| EP | 2818068 | A1 | 12/2014 |
| EP | 2848141 | A1 | 3/2015 |
| EP | 2937007 | A1 | 10/2015 |
| EP | 3167742 | A1 | 5/2017 |
| FR | 2994800 | A1 | 3/2014 |
| GB | 1154145 | A | 6/1969 |
| GB | 1358470 | A | 7/1974 |
| GB | 2517399 | A | 2/2015 |
| GB | 2533809 | A | 7/2016 |
| JP | H0181910 | U | 6/1989 |
| JP | H10179210 | A | 7/1998 |
| JP | 2001149394 | A | 6/2001 |
| JP | 2004236860 | A | 8/2004 |
| JP | 2006055571 | A | 3/2006 |
| JP | 2008206629 | A | 9/2008 |
| KR | 20090130804 | A | 12/2009 |
| KR | 20130119566 | A | 11/2013 |
| NL | 1020208 | C1 | 9/2003 |
| TW | 585748 | B | 5/2004 |
| TW | M261248 | U | 4/2005 |
| TW | M275736 | U | 9/2005 |
| TW | 200930315 | A | 7/2009 |
| TW | 201130440 | A | 9/2011 |
| TW | M449484 | U | 4/2013 |
| TW | M469778 | U | 1/2014 |
| TW | I581730 | B | 5/2017 |
| WO | 8808678 | A1 | 11/1988 |
| WO | 9737556 | A1 | 10/1997 |
| WO | 03039283 | A1 | 5/2003 |
| WO | 2005070246 | A2 | 8/2005 |
| WO | 2006084185 | A1 | 8/2006 |
| WO | 2007024875 | A2 | 3/2007 |
| WO | 2007080205 | A1 | 7/2007 |
| WO | 2008115743 | A1 | 9/2008 |
| WO | 2008152414 | A1 | 12/2008 |
| WO | 2009154350 | A1 | 12/2009 |
| WO | 2010048203 | A1 | 4/2010 |
| WO | 2010059716 | A2 | 5/2010 |
| WO | 2010114993 | A1 | 10/2010 |
| WO | 2011004946 | A1 | 1/2011 |
| WO | 2011140584 | A1 | 11/2011 |
| WO | 2012044974 | A1 | 4/2012 |
| WO | 2012168956 | A1 | 12/2012 |
| WO | 2013039385 | A1 | 3/2013 |
| WO | 2013187288 | A1 | 12/2013 |
| WO | 2014033396 | A1 | 3/2014 |
| WO | 2014038937 | A1 | 3/2014 |
| WO | 2014140443 | A1 | 9/2014 |
| WO | 2015002521 | A1 | 1/2015 |
| WO | 2015198460 | A1 | 12/2015 |
| WO | 2016005696 | A1 | 1/2016 |
| WO | 2016015161 | A1 | 2/2016 |
| WO | 2016196195 | A1 | 12/2016 |
| WO | 2018092023 | A1 | 5/2018 |
| WO | 2018193276 | A1 | 10/2018 |

OTHER PUBLICATIONS

Aidin H., Under Armour's Innovative Fall/Winter 2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).

Kizik Design, Kizik® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

Nike Ease Challenge Winner Announced, Nike News, Apr. 25, 2017, https://news.nike.com/news/nike-ease-challenge-winner-announced (accessed May 2, 2018).

U.S. Appl. No. 61/260,621, filed Nov. 12, 2009.

U.S. Appl. No. 62/326,650, filed Apr. 22, 2016.

U.S. Appl. No. 62/368,497, filed Jul. 29, 2016.

* cited by examiner

FOOTWEAR WITH LACELESS FASTENING SYSTEM

CROSS-REFERENCE TO RELATED APPLICATION

This application claims the benefit of priority to U.S. Provisional Application No. 62/464,571, filed Feb. 28, 2017, which is hereby incorporated by reference in its entirety.

TECHNICAL FIELD

The present teachings generally include an article of footwear with a laceless fastening system.

BACKGROUND

Footwear may include a sole structure configured to be located under a wearer's foot to space the foot away from the ground. A footwear upper attached to the sole structure receives the foot. The fit of the upper to the foot may be adjusted with a fastening system so that the upper is loose enough to receive the foot but can be tightened around the foot to secure the foot to the sole structure. For example, fastening systems may include laces that are tied once the foot is received within the upper.

DESCRIPTION

Figure 1:
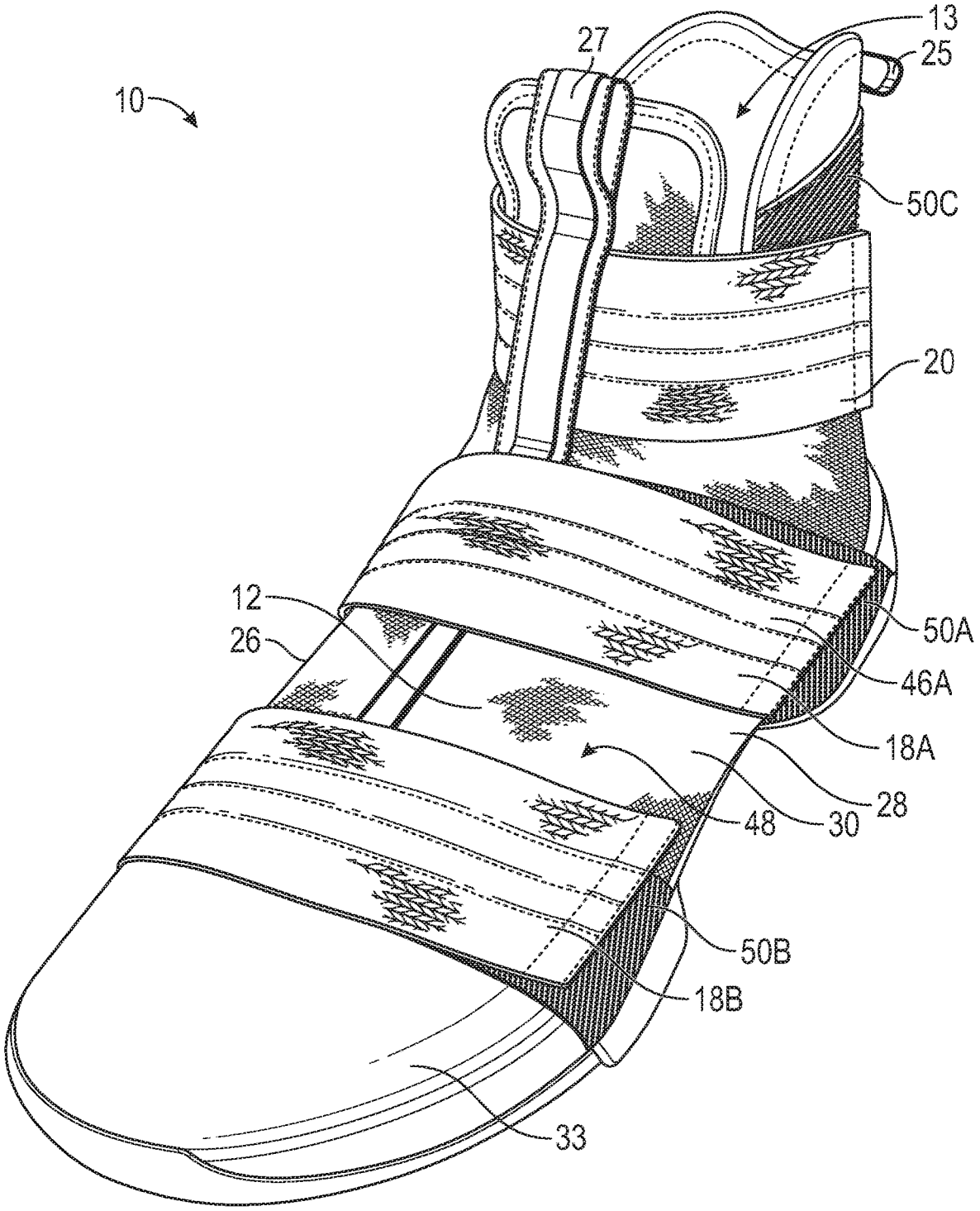
FIG. 1 is a schematic illustration in perspective view of an embodiment of an article of footwear.

An article of footwear is provided with a laceless fastening system that enables a lightweight, flexible upper to be "locked out" around a foot. The article of footwear includes an upper having a body with a first side and a second side. The article of footwear further comprises a laceless fastening system that includes a strap having an anchored end fixed adjacent to the second side of the body and a distal end selectively remote from the upper. The strap has an inner side and an outer side. A first fastener is fixed to an outer surface of the body on the first side. The first fastener is less elastic than the body. A segmented second fastener configured to secure to the first fastener is fixed to the inner side of the strap. The segmented second fastener includes a proximal segment and a distal segment, with the distal segment closer to the distal end of the strap than the proximal segment and spaced apart from the proximal segment along the strap such that an exposed portion of the strap is between the proximal segment and the distal segment. The segmented second fastener is less elastic than the strap. The strap is configured to cross over the body from the second side to the first side such that the distal segment overlies and secures to the first fastener, with the inner side of the strap facing the outer surface of the body, and with the proximal segment against the body on the second side. The body is unrestrained by the strap when the segmented second fastener is remote from the first fastener. As used herein, an "end" of a strap, such as a distal end or a proximal end, includes a portion adjacent the terminal edge of the strap, and is not limited to the terminal edge.

The fastening system combines the advantages of an adjustable and secure fit with the ease of insertion of a foot enabled by the relatively flexible and elastically stretchable body, and the strap that can be secured in a single motion with one hand. Securing the strap locks out the body so that the foot is anchored in position within the upper and the upper and underlying sole structure move as a unit with the foot (i.e., with minimal relative motion) including during lateral and/or jumping moves. The fastening system may include only the straps and the fasteners described herein, and the footwear may be configured so that it has no other fastening components such as laces, cables, buckles or other components that must be tied, tightened, buckled or otherwise adjusted to secure the foot within the upper.

Elastic stretchability of the body at the first fastener is inhibited by the first fastener. Elastic stretchability of the body on the second side is that of the body when the second fastener is remote from the first fastener and is inhibited by the strap when the second fastener is secured to the first fastener. Elastic stretchability of the strap at the second fastener is inhibited by the second fastener such that elastic stretchability of the strap at the exposed portion of the strap is greater than elastic stretchability of the strap at the second fastener.

For example, the body may include foam and textile and may be relatively elastic, while the first and second fasteners may be hook-and-loop fasteners. One of the first fastener and the second fastener is a plurality of loops and the other of the first fastener and the second fastener (i.e., the other one that is not a plurality of loops) is a plurality of hooks configured to engage with the plurality of loops when the second fastener is pressed against the first fastener.

The second fastener is configured to secure to the first fastener when the distal end of the strap is pressed toward the upper, and is configured to release from the first fastener when the distal end of the strap is pulled away from the upper.

The second fastener may be configured so that a portion of the proximal segment is secured to the first fastener when the distal segment is secured to the first fastener. The proximal segment may extend from the anchored end to the exposed portion. In an embodiment in which the anchored end is secured to the sole structure below the upper, the proximal segment extends from the sole structure and along the second side of the body to the first fastener.

The strap is elastically stretched at the exposed portion when the second fastener is secured to the first fastener so that the strap is extended in tension. The first fastener is substantially inelastic and inhibits stretching of the body at the first fastener. The second fastener is substantially inelastic and inhibits stretching of the strap lengthwise except at the exposed portion.

In an embodiment, a sole structure is secured to a lower portion of the body. To fix the foot within the upper relative to the sole structure, the anchored end of the strap is fixed to sole structure. For example, the sole structure may include an outsole, and a midsole attached to the outsole between the upper and the outsole. The anchored end of the strap may be disposed between the midsole and the outsole. Similarly, an end of the first fastener may be fixed to the sole structure between the midsole and the outsole adjacent to the second side.

The strap may extend over the midfoot portion of the body, the forefoot portion of the body, or the ankle portion of the body in different embodiments. In some embodiments, there is both a forefoot strap and a midfoot strap as described. In some embodiments, there is a forefoot strap, a midfoot strap, and an ankle strap as described. In an embodiment, the first side of the body is a lateral side and the second side of the body is a medial side, and the anchored end of the strap is at least partially forward of the first fastener such that the strap extends rearward from the medial side to the lateral side when the second fastener is secured to the first fastener.

In some embodiments, the strap is a first strap and extends over the midfoot portion of the body, and the laceless fastening system also includes a similar additional strap that extends over the forefoot portion of the body and/or an additional strap that extends over the ankle portion of the body. The additional strap has an anchored end fixed adjacent to the second side of the body and a distal end selectively remote from the upper. The additional strap has an inner side and an outer side, and an additional first fastener fixed to the outer surface of the body on the first side. The additional first fastener is less elastic than the body. An additional segmented second fastener is fixed to the inner side of the additional strap. The additional segmented second fastener includes a proximal segment and a distal segment, with the distal segment of the additional segmented fastener closer to the distal end of the additional strap than the proximal segment and spaced apart from the proximal segment along the additional strap such that an exposed portion of the additional strap is between the proximal segment and the distal segment of the additional strap. The additional segmented second fastener is less elastic than the additional strap. The additional strap is configured to cross over the body from the second side to the first side and the distal segment of the additional strap is configured to secure to the additional first fastener, with the inner side of the additional strap facing the outer surface of the body, and with the proximal segment of the additional segmented second fastener against the body on the second side.

In an embodiment, the body has an ankle portion, and the laceless fastening system further comprises an additional fastener fixed to the first side of the body in the ankle portion, and also comprises a third strap having an anchored end secured to the ankle portion of the body and having a distal end selectively remote from the upper. The third strap has an inner side and an outer side, and another additional fastener is secured to the inner side of the third strap, and is configured to secure to the additional fastener with the third strap wrapping around the ankle portion of the body from the second side to the first side. In some embodiments, the additional fastener secured at the inner side of the third strap is also a segmented fastener. In such embodiments, the additional fastener includes a proximal segment and a distal segment that is closer to the distal end than the proximal segment, and is spaced apart from the proximal segment along the additional strap such that an exposed portion of the additional strap is between the proximal segment and the distal segment.

In an embodiment, an article of footwear comprises an upper having an elastic body forming a cavity configured to receive a foot. The article of footwear includes a laceless fastening system for securing the body around the foot. The laceless fastening system includes a first fastener comprising a first strip of hook-and-loop fastener material secured to a lateral side of the body, and a strap having a fixed end fixed adjacent to a medial side of the body and having a free end selectively remote from the upper. The laceless fastening system includes a second fastener configured to secure to the first fastener by contact with the first fastener. The second fastener includes a second strip of hook-and-loop fastener material secured to an inner face of the strap. A third strip of hook-and-loop fastener material is secured to the inner face of the strap nearer the free end than the second strip and spaced apart from the second strip along the inner face of the strap. The second strip and the third strip are both either a plurality of hooks or a plurality of loops securable to a plurality of hooks, and the first strip is the other of the plurality of hooks and the plurality of loops. The strap wraps over and across the upper to the lateral side, with the second strip overlying the body on the medial side and partly overlying the first strip, and with the third strip overlying the first strip. The second strip and the third strip secure to the first strip with the strap stretching in tension between the second strip and the third strip.

In an embodiment, the strap is a first strap and overlies a midfoot portion of the body to support an arch of a foot received in the cavity when the third strip is secured to the first strip. The laceless fastening system further includes an additional first strip of hook-and-loop fastener material secured to a lateral side of the body forward of the first strip, a second strap spaced forward of the first strap and having a fixed end fixed adjacent the medial side of the body and having a free end selectively remote from the upper. The laceless fastening system further includes an additional second strip of hook-and-loop fastener material secured to an inner face of the second strap, and an additional third strip of hook-and-loop fastener material secured to the inner face of the second strap nearer the free end of the second strap than the additional second strip, and spaced apart from the additional second strip along the inner face of the second strap. The additional second strip and the additional third strip are both a plurality of hooks or are both a plurality of loops securable to a plurality of hooks, and the additional first strip is the other one of the plurality of hooks and the plurality of loops. The second strap is configured to wrap over and across the upper to the lateral side with the inner face of the second strap facing the upper, with the additional second strip overlying the body on the medial side and partly overlying the additional first strip, and with the additional third strip overlying the additional first strip. The additional second strip and the additional third strip are configured to secure to the additional first strip with the second strap stretching in tension between the additional second strip and the additional third strip, and the second strap overlies a forefoot portion of the body on the medial side.

The laceless fastening system may also include an ankle strap having a similar second fastener with a second and third strip as described, and that overlies an ankle portion of the body to secure to a first fastener with a first hook-and-loop fastener material secured to the ankle portion at the lateral side of the body.

The above features and advantages and other features and advantages of the present teachings are readily apparent from the following detailed description of the modes for carrying out the present teachings when taken in connection with the accompanying drawings.

Figure 6:
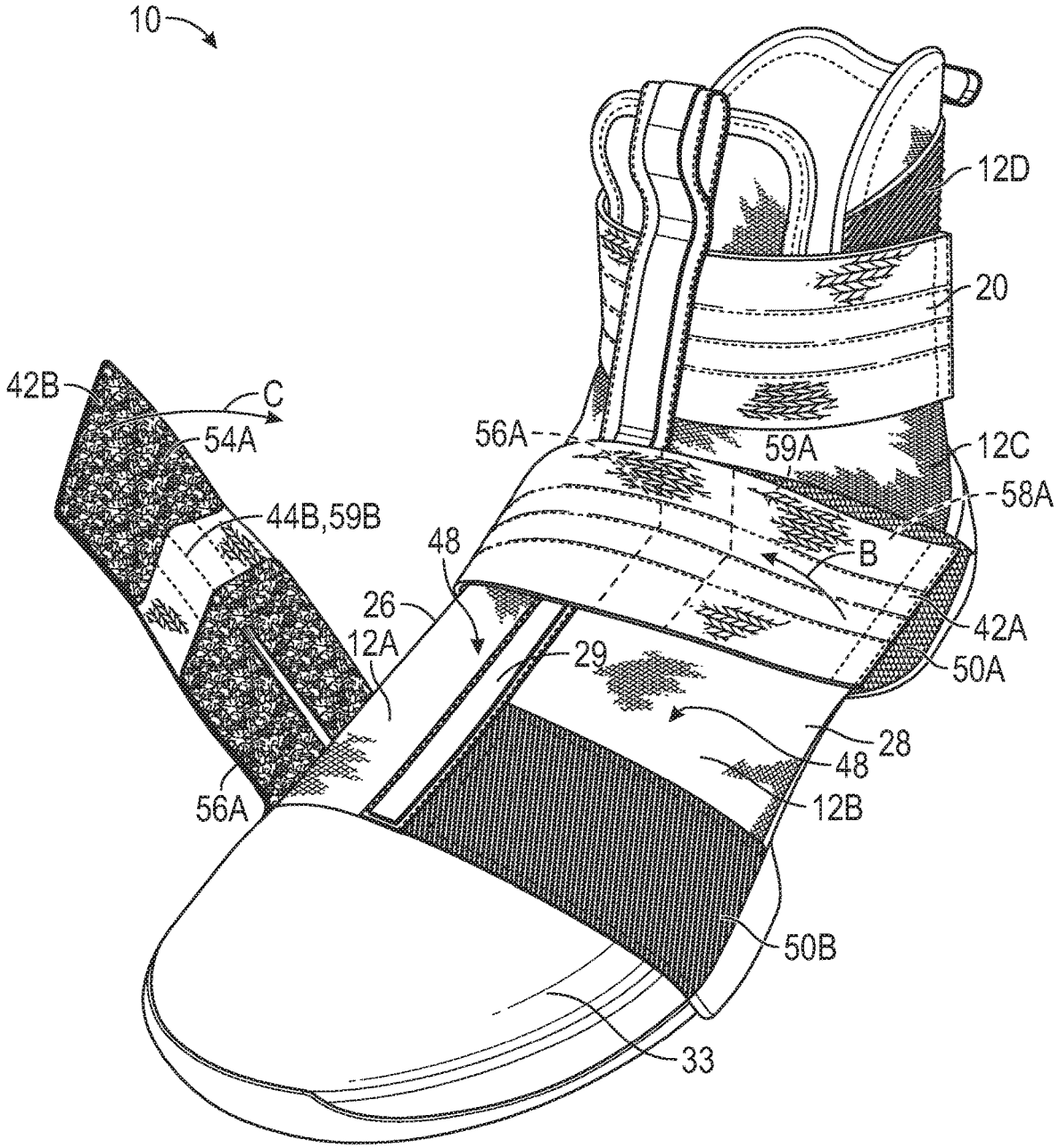
FIG. 6 is a schematic illustration in perspective view of the article of footwear of FIG. 1 with a forefoot strap in an unsecured position.

Referring to the drawings, wherein like reference numbers refer to like components throughout the views, FIG. 1 shows an article of footwear 10 that has an upper 12 that forms a cavity 13 configured to receive a foot 16 (shown in phantom). The cavity 13 is also referred to as a foot cavity. The upper 12 is secured with a laceless fastening system 14 around the foot 16. More specifically, a body 30 of the upper 12 is a relatively flexible and elastically stretchable material promoting ease of insertion of the foot 16. As indicated in FIG. 6, the body 30 of the upper 12 has a forefoot portion 12A, a midfoot portion 12B, a heel portion 12C, and an ankle portion 12D, which are also the forefoot portion, the midfoot portion, the heel portion, and the ankle portion, respectively, of the body 30. Releasably securable straps 18A, 18B, 20 of the laceless fastening system 14 include a midfoot strap 18A, a forefoot strap 18B, and an ankle strap 20. The midfoot strap 18A is also referred to as a first strap, the forefoot strap 18B is referred to as a second strap or as an additional strap, and the ankle strap 20 is referred to as a third strap or an additional strap.

Each of the straps 18A, 18B, 20 has a free end that secures to a fastener on the upper 12 via a single pressing motion toward the upper 12, and releases from the fastener via a single peeling motion away from the upper 12. The laceless fastening system 14 provides an adjustable, secure fit to tighten the body 30 around the foot 16 and secure the foot 16 relative to a sole structure 24 underlying the upper 12. As further discussed herein, fasteners are disposed on the midfoot strap 18A and the forefoot strap 18B and on the upper 12 to provide a desirable combination of support at both the medial side 26 and the lateral side 28 of the body 30, "locking out" the upper 12 while still enabling adjustability in tightness and position of the straps 18A, 18B. As used herein, the upper 12 is locked out when its elastic stretchability is inhibited by an overlying, less elastic strap.

The footwear 10 illustrated herein is an athletic shoe configured for sports such as basketball, but the footwear 10 and fastening system 14 is not limited to basketball shoes. The fastening system 14 may be also be used in footwear for various other sports such as but not limited to running, tennis, football, soccer, etc. The fastening system 14 may also be included in an article of footwear that is a dress shoe, a work shoe, a sandal, a slipper, a boot, or any other category of footwear.

With reference to FIGS. 1-5, the medial side 26 of the body 30 is also referred to as the second side of the body 30, and the lateral side 28 of the body 30 is also referred to as the first side of the body 30. In other embodiments, the lateral side 28 could be the first side referred to herein, and the medial side 26 could be the second side referred to herein. The medial side 26 and the lateral side 28 of the body 30 are also the medial side 26 and the lateral side 28 of the article of footwear 10.

The body 30 is comprised of a base material that extends over at least a portion of the medial side 26 and the lateral side 28. In the embodiment shown, the base material includes foam and textile that may be thermally bonded to one another. The textile may be knitted, braided, or woven strands of a generally flexible and lightweight material. The body 30 has an elastic stretchability that may be greater than that of the material of the midfoot strap 18A, the forefoot strap 18B, and the ankle strap 20, and is greater than the elastic stretchability of portions of the straps 18A, 18B, 18C to which segmented fasteners are secured, as described herein. In the embodiment shown, the midfoot strap 18A, the forefoot strap 18B, and the ankle strap 20 are a knit material. Other materials may be used for the body 30 and the midfoot strap 18A, the forefoot strap 18B, and the ankle strap 20. When segmented fasteners are secured to the midfoot strap 18A, the forefoot strap 18B, and the ankle strap 20 as described herein, the elastic stretchability of the straps 18A, 18B, 18C at the segmented fasteners is less than that of the body 30, enabling them to provide greater support to the upper 12 when fastened as described herein. "Elastic stretchability", as used herein, is the percentage elongation of a component when subjected to a given load at a given rate. In one non-limiting example, the elastic stretchability of each strap 18A, 18B, 18C at the segmented fastener thereon may be less than or equal to about 5% elongation when the strap 18A, 18B, or 18C is pulled along its length with 40 kilograms force at 500 millimeters per minute loading rate.

Figure 5:
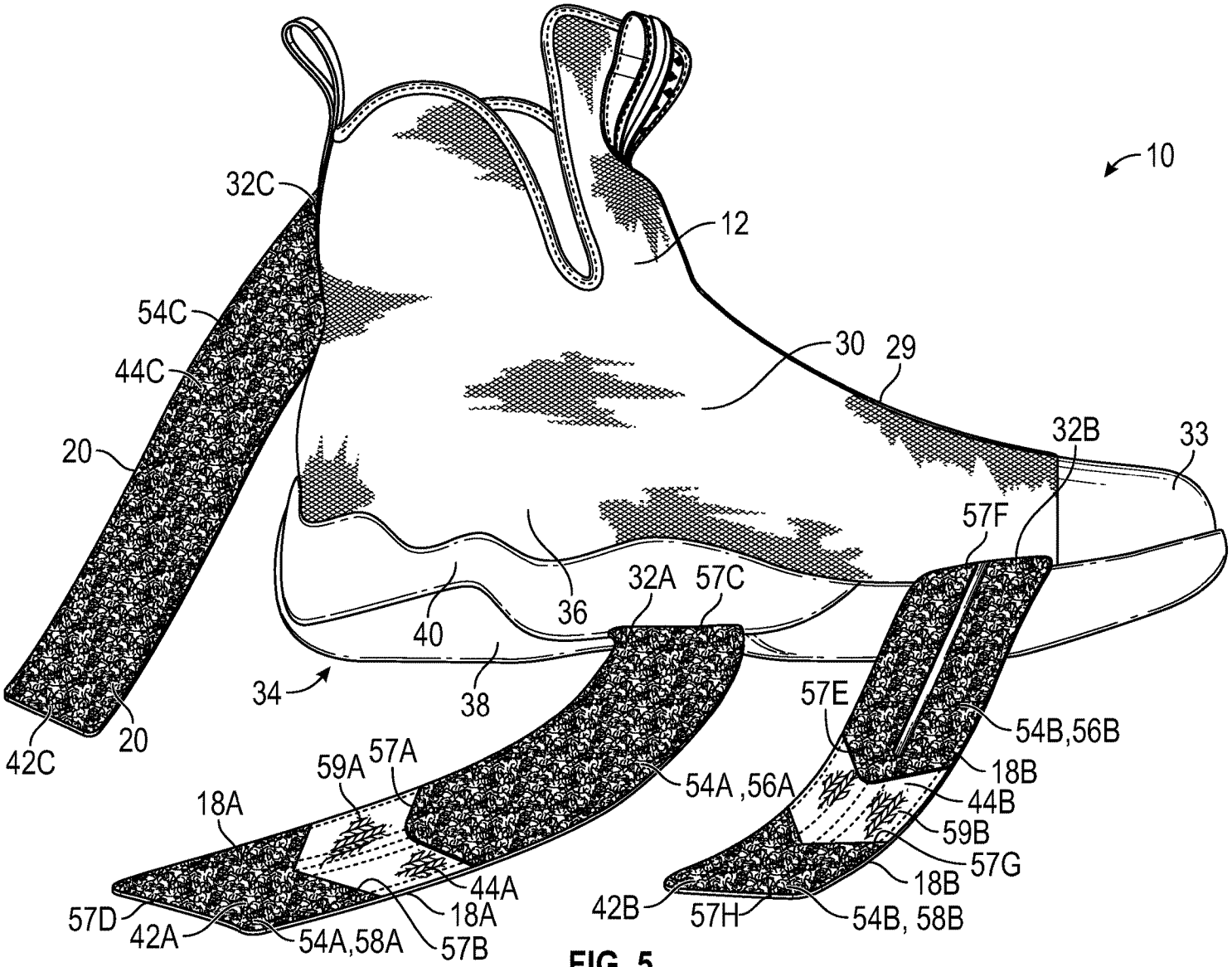
FIG. 5 is a schematic illustration in side view of the medial side of the article of footwear of FIG. 1 with a forefoot strap, a midfoot strap, and an ankle strap in unsecured positions.

In the embodiment, shown, the body 30 of the upper 12 extends over the entire upper 12 in the area of the midfoot strap 18A, the forefoot strap 18B, and the ankle strap 20. Most specifically, the entire medial side 26 of the body 30 above the anchored end of the straps 18B, 20 is the flexible, relatively elastic base material, as best shown in FIG. 5. Other materials may be used in other portions of the upper 12, such as the less elastic leather toe cap 33. Alternatively, the body 30 could instead also cover the toe portion of the upper 12. With the body 30 disposed in this manner, the medial side 26 of the body 30 has an elastic stretchability that is not inhibited by the straps 18B, 20 when they are unfastened, as shown in FIG. 5.

Figure 2:
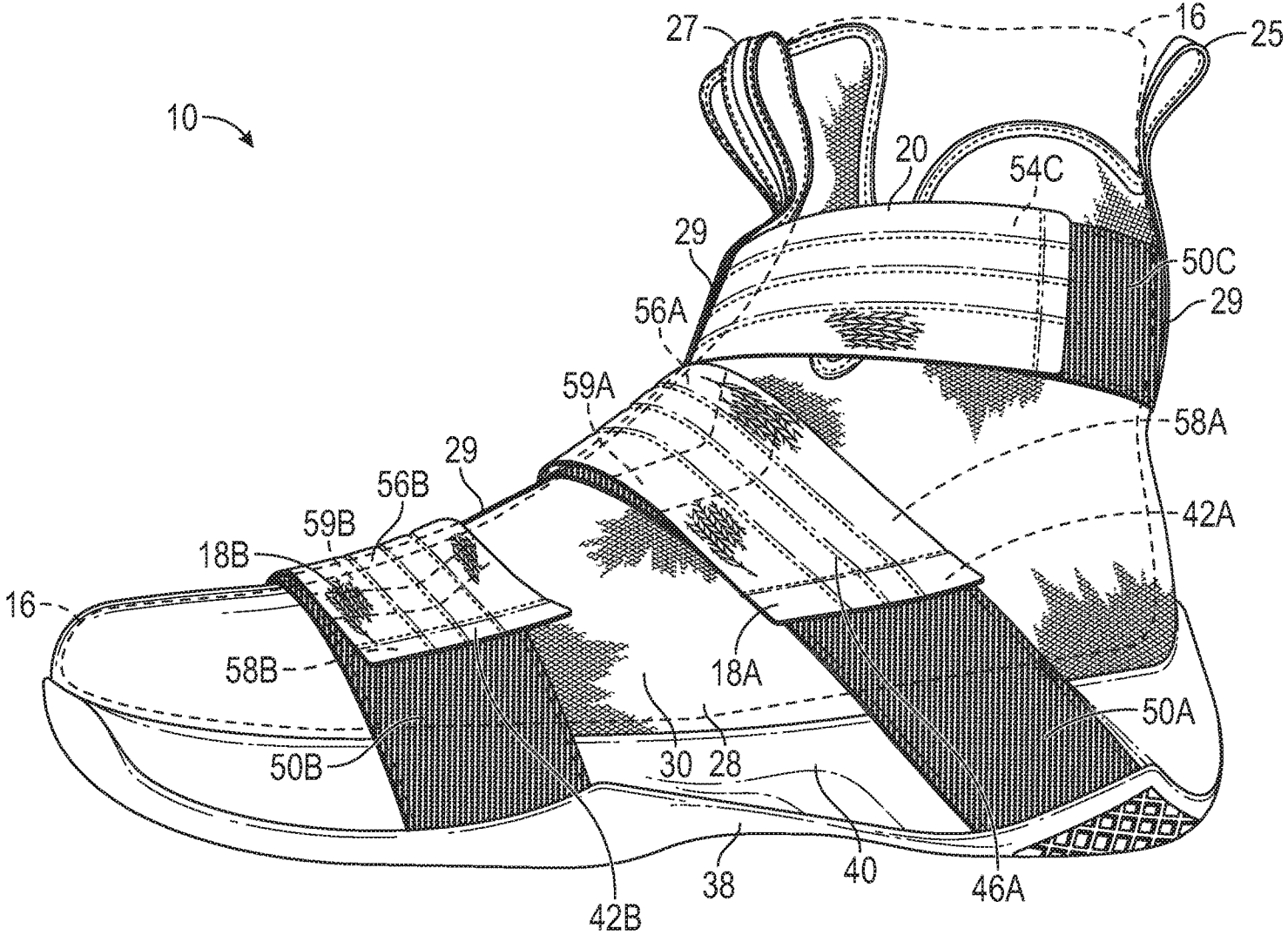
FIG. 2 is a schematic illustration in side view of a lateral side of the article of footwear of FIG. 1.

Referring to FIG. 2, in the embodiment shown, a heel pull 25 is disposed near foot cavity 13 and allows a user to grab a hold of and pull the article of footwear 10 onto the foot 16. A front pull 27, which is also referred to as a tongue pull, allows the user to also pull the footwear 10 over the top of the foot 16. The heel pull 25 and front pull 27 may be looped portions of flat ribbons 29 of flexible material stitched to the body 30 along the crest of the upper 12 at the midfoot 12B and at the rear of the heel portion 12C. As shown, the ribbon 29 forms loops that the ankle strap 20 passes through. The ribbon 29 also covers ends of the fasteners 50A, 50B at the crest of the body 30 between the medial side 26 and the lateral side 28.

Figure 3:
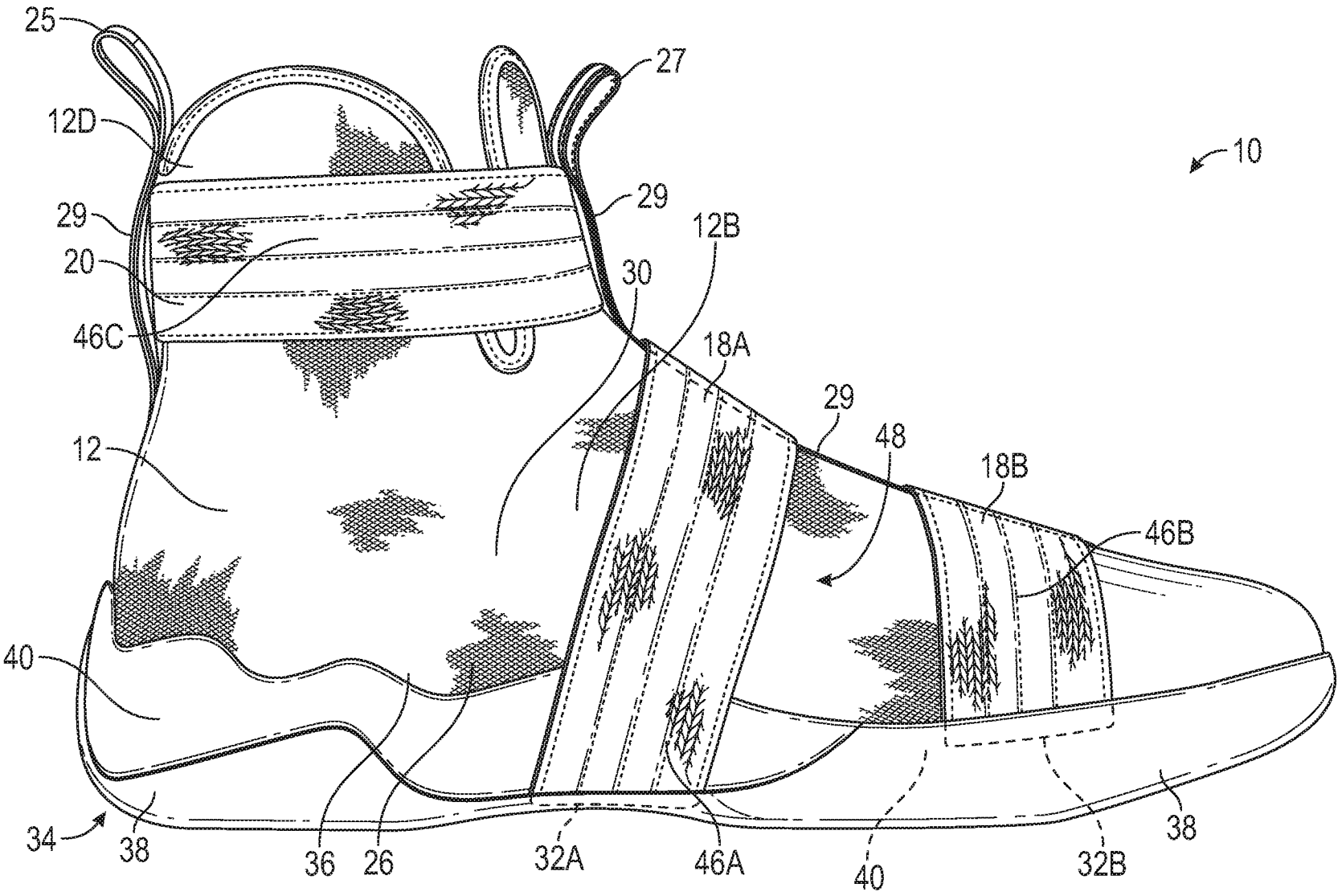
FIG. 3 is a schematic illustration in side view of a medial side of the article of footwear of FIG. 1.

The midfoot strap 18A has an anchored end 32A fixed adjacent the medial side 26 of the body 30. The anchored end 32A is also referred to as a fixed end. More specifically, as shown in FIG. 3, the anchored end 32A is secured to a sole structure 34 of the article of footwear 10. The sole structure 34 is attached to a lower portion 36 of the body 30 of the upper 12. The sole structure 34 includes an outsole 38 and a midsole 40. The midsole 40 is attached to the outsole 38, such as by thermal bonding or adhesive, and is disposed between the upper 12 and the outsole 38. The upper 12 may be directly attached to the midsole 40 such as by bonding, stitching, or adhesive. The outsole 38 may be a material providing significant traction, such as rubber. The midsole 40 may be a more resilient material, such as foam, and may include additional structure such as one or more fluid-filled bladders that may include tensioning components, such as tethers within the bladders as shown in commonly-owned U.S. Pat. No. 9,271,544, issued Mar. 1, 2016 and incorporated by reference herein in its entirety. The anchored end 32A of the midfoot strap 18A is fixed to the sole structure 34 between the midsole 40 and the outsole 38 as shown in FIG. 3. For example, the anchored end 32A may be stitched to the midsole 40 or adhered to the midsole 40 and outsole 38. Securing the anchored end 32A to the sole structure 34 locks the foot 16 and the body 30 of the upper 12 for common movement with the sole structure 34, providing greater stability such as, for example, with lateral cutting motions.

Figure 7:
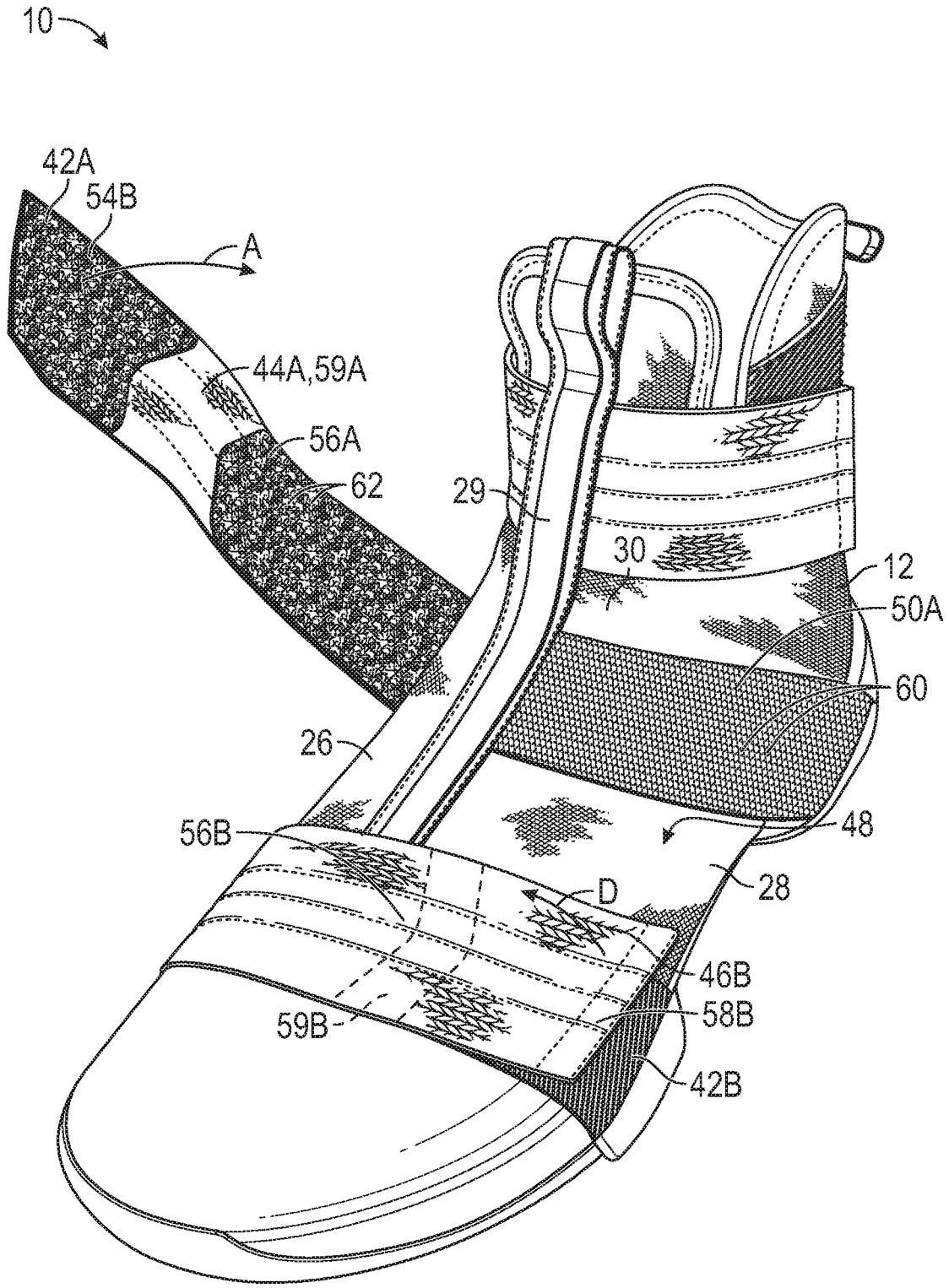
FIG. 7 is a schematic illustration in perspective view of the article of footwear of FIG. 1 with a midfoot strap in an unsecured position.

The midfoot strap 18A has a distal end 42A selectively remote from the upper 12. The distal end 42A may also be referred to as a "free end" as it is freely movable when not secured to the upper 12. FIGS. 5 and 7 show the distal end 42A remote from the upper 12. FIG. 2 shows the distal end 42A selectively secured to the upper 12 via the fasteners described herein. The midfoot strap 18A has an inner side 44A (shown in FIGS. 5 and 7) and an outer side 46A (shown for example in FIGS. 1, 2, and 3), which may also be referred to as an inner surface 44A or inner face 44A and an outer surface 46A or outer face 46A, respectively. When the distal end 42A is selectively secured to the upper 12, the inner side 44A faces the outer surface 48 of the body 30 and the outer side 46A faces outward, away from the outer surface 48.

Figure 4:
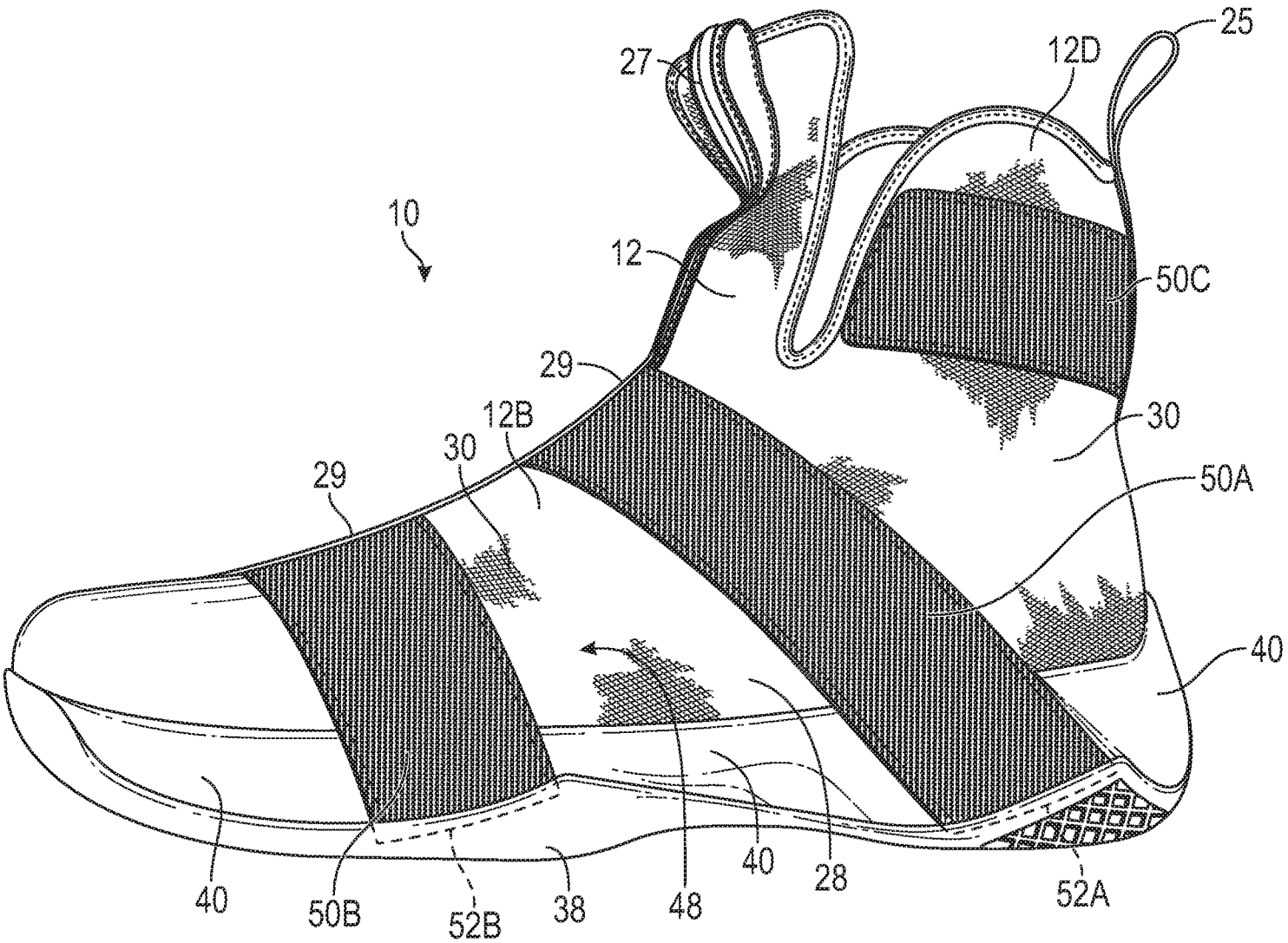
FIG. 4 is a schematic illustration in side view of the lateral side of the article of footwear of FIG. 1 showing first fasteners.

As best shown in FIGS. 4 and 7, a first fastener 50A is fixed to the outer surface 48 of the body 30 on the lateral side 28 of the upper 12. The first fastener 50A extends generally from an uppermost extent of the body 30 over the top of the midfoot portion 12B and over a side surface of the midsole 40. Similar to the first strap 18A, a distal end 52A of the first fastener 50A may be fixed to the sole structure 34, and disposed between the midsole 40 and the outsole 38 and, more specifically, sandwiched between the midsole 40 and the outsole 38. The first fastener 50A is less elastic than the body 30. In the embodiment shown, the first fastener 50A is substantially inelastic. In one non-limiting example, the elastic stretchability of the first fastener 50A is less than or equal to about 5% elongation when the first fastener 50A is pulled along its length with 40 kilograms force at 500 millimeters per minute loading rate. As used herein, "substantially inelastic" means that a component has an elastic stretchability of less than or equal to about 5% elongation when pulled along its length with a given force at a given loading rate.

Accordingly, elastic stretchability of the body 30 at the first fastener 50A is inhibited by the less elastic first fastener 50A overlying and fixed to the body 30. The first fastener 50A inhibits stretching of the body 30 when the first fastener 50A is fixed to and overlies the body 30 at the first fastener.

A segmented second fastener 54A is fixed to the inner side 44A of the midfoot strap 18A. The segmented second fastener 54A is referred to as segmented because it includes a proximal segment 56A and a distal segment 58A. The distal segment 58A is closer to the distal end 42A of the midfoot strap 18A than is the proximal segment 56A. The distal segment 58A is spaced apart from the proximal segment 56A along the inner side 44A of the midfoot strap 18A such that an exposed portion 59A of the inner side 44A of the midfoot strap 18A is between a distal edge 57A of the proximal segment 56A and a proximal edge 57B of the distal segment 58A. The proximal segment 56A of the strap 18A has a first end 57C and has a second end 57A (also referred to as the distal edge 57A). The distal segment 58A has a first end 57B (also referred to as the proximal edge 57B) and has a second end 57D. The exposed portion 59A is between the second end 57A of the proximal segment 56A and the first end 57B of the distal segment 58A. The second end 57A of the proximal segment 56A and the first end 57B of the distal segment 58A are non-linear so that the exposed portion 59A is chevron-shaped. The segmented second fastener 54A is less elastic than the midfoot strap 18A. In the embodiment shown, the segmented second fastener 54A is substantially inelastic. In one non-limiting example, the elastic stretchability of either segment of the second fastener 54A is less than or equal to about 5% elongation when the second fastener 54A is pulled along its length with 40 kilograms force at 500 millimeters per minute loading rate. Elastic stretchability of the midfoot strap 18A at the second fastener 54A is inhibited by the second fastener 54A on portions of the midfoot strap 18A where the second fastener 54A overlies and is fixed to the midfoot strap 18A. Stated differently, the segmented second fastener 54A inhibits stretching of the midfoot strap 18A lengthwise except at the exposed portion 59A. Elastic stretchability of the midfoot strap 18A at the exposed portion 59A of the midfoot strap 18A is that of the material of the midfoot strap 18A, and is not inhibited by the second fastener 54A as it is not overlain by or fixed to the second fastener 54A. Elastic stretchability of the midfoot strap 18A at the exposed portion 59A is thus greater than elastic stretchability of the midfoot strap 18A at the second fastener 54A (i.e., at the portions of the midfoot strap 18A to which the distal segment 58A and proximal segment 56A are fixed). In one non-limiting example, the elastic stretchability of the midfoot strap 18A at the exposed portion 59A may be greater than or equal to about 20% elongation when the midfoot strap 18A is pulled along its length with 40 kilograms force at 500 millimeters per minute loading rate.

Accordingly, sufficient tensile force applied along the length of the midfoot strap 18A will cause the midfoot strap 18A to stretch in tension at the exposed portion 59A, while the less elastic proximal segment 56A and the distal segment 58A inhibit (i.e., lockout) stretch of the midfoot strap 18A at a portion of the midfoot strap 18A to which the segmented second fastener 54A is fixed.

Figure 8:
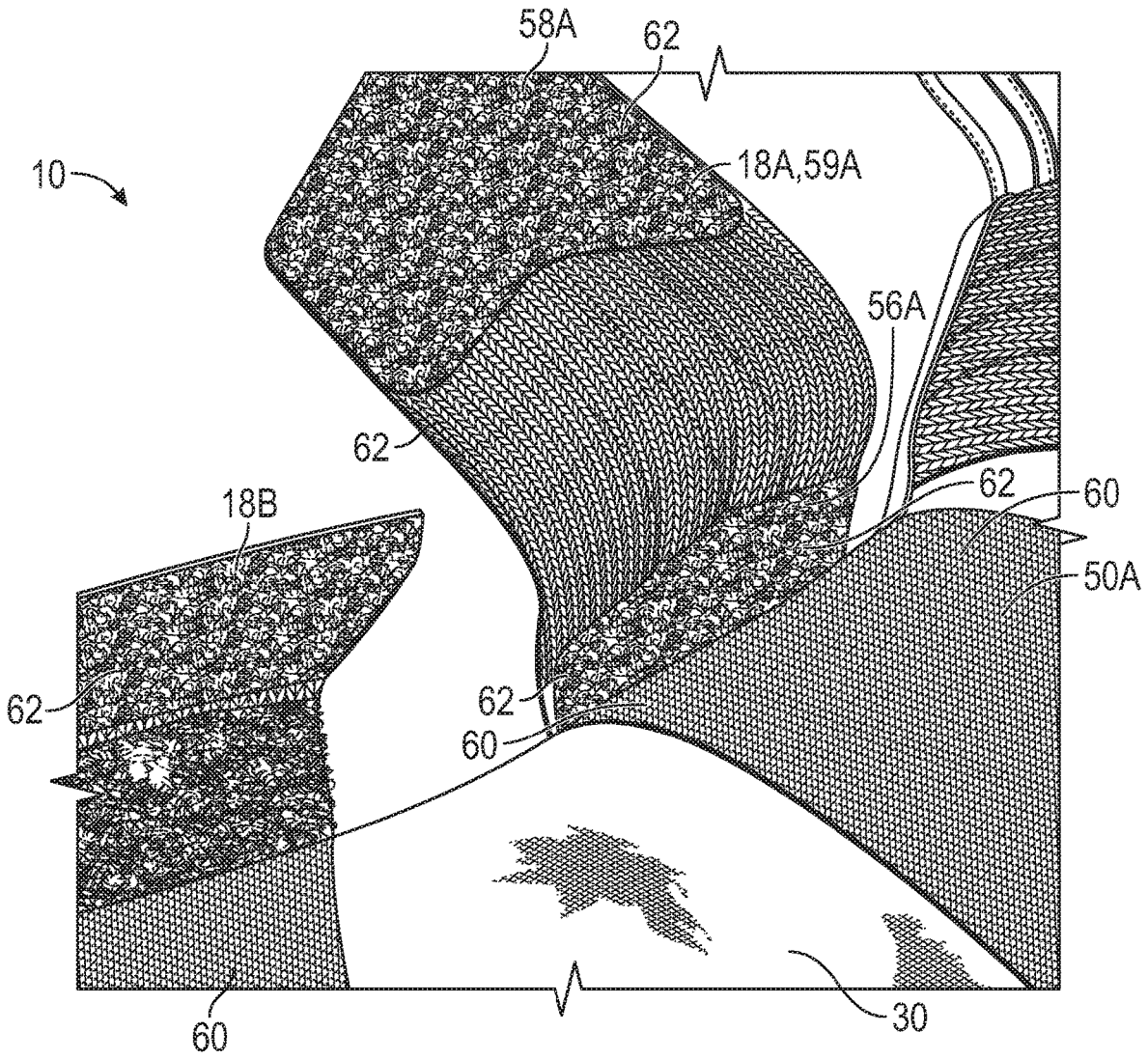
FIG. 8 is schematic illustration in fragmentary perspective view of the article of footwear of FIG. 1 showing a portion of the inner surfaces of the forefoot strap and the midfoot strap.

In one embodiment, the first and second fasteners 50A, 54A are hook-and-loop fastener material. One of the first fastener 50A and the second fastener 54A is a plurality of loops and the other one of the first fastener 50A and the second fastener 54A is a plurality of hooks configured to engage with the plurality of loops when the second fastener 54A contacts the first fastener 50A, such as when the second fastener 54A is pressed against the first fastener 50A. In the embodiments shown, the first fastener 50A is a plurality of loops 60, and the second fastener 54A is a plurality of hooks 62 as best illustrated in FIG. 8. In another embodiment, the first fastener 50A could be a plurality of hooks, and the second fastener 54A could be a plurality of loops. The first fastener 50A may thus be referred to as a first strip of hook-and-loop fastener material, the proximal portion 56A of the second fastener 54A may be referred to as a second strip of hook-and-loop fastener material, and the distal portion 58A of the second fastener 54A may be referred to as a third strip of hook-and-loop fastener material.

In other embodiments, the fasteners could include a plurality of loops and a plurality of hooks that have double-pronged ends. In another embodiment, the fastening system may be a mechanical interlocking fastening system, such as a fastening system in which the second fastener has multiple spaced protrusions and the first fastener has recesses in which the protrusions of the second fastener nest and engage the first fastener. In another embodiment of a mechanical fastening system, the first and second fasteners are each a plurality of spaced stems that have enlarged ends. The enlarged ends of the first fastener interlock with the enlarged ends of the second fastener when the second fastener is pressed against the first fastener. In another embodiment, the fastening system can be a magnetic fastening system in which the first and second fasteners are a permanently magnetizable material, magnetized with rows of alternating poles so that the first and second fasteners magnetically secure to one another.

The midfoot strap 18A is configured such that the distal end 42A of the midfoot strap 18A crosses over the body 30 from the medial side 26 to the to the lateral side 28 and the distal segment 58A secures to the first fastener 50A, as best shown in movement of the distal end 42A of the midfoot strap 18A in the direction of arrow A from the unsecured position of FIG. 7 to the secured positon of FIG. 6. The midfoot strap 18A overlies the midfoot portion 12B of the upper 12 and the second fastener 54A secures to the first fastener 50A by the hooks 62 and loops 60 of the fasteners 50A, 54A engaging when the second fastener 54A overlies and presses against the first fastener 50A. Stated differently, the proximal segment 56A or second strip overlies the body 30 on the medial side 26 and partly overlies and secures to the first fastener 50A, and the distal segment 58A overlies the first fastener 50A. The midfoot strap 18A releases from the first fastener 50A when the distal end 42A of the midfoot strap 18A is pulled away from the upper 12, such as by peeling the distal end 42A in the direction of arrow B in FIG. 6, to release the engaged hooks 62 and loops 60 of the fasteners 50A, 54A.

In the secured position of FIGS. 3 and 6, the inner side 44A of the midfoot strap 18A faces the outer surface 48 of the upper 12, and the proximal segment 56A is held against the body 30 on the medial side 26 of the upper 12. The midfoot strap 18A elastically stretches at the exposed portion 59A when pulled in tension and pressed toward the upper 12 so that the second fastener 54A secures to the first fastener 50A, causing the midfoot strap 18A to remain extended in tension at the exposed portion when in the secured position of FIG. 2. The proximal segment 56A extends from the anchored end 32A to the exposed portion 59A. As shown in FIGS. 2, 6, and 8, the proximal segment 56A has a length sufficient such that a portion of the proximal segment 56A nearest the exposed portion 59A is also secured to the first fastener 50A when the distal segment 58A is secured to the first fastener 50A.

Elastic stretchability of the body 30 on the medial side 26 is uninhibited when the second fastener 54A is remote from the first fastener 50A as the body 30 is unrestrained by the midfoot strap 18A when the segmented second fastener 54A is remote from the first fastener 50A, such as shown in FIG. 5. This allows the body 30 to stretch during insertion of the foot 16 to accommodate and conform to the girth of the inserted foot 16. Elastic stretchability of the body 30 at the overlying midfoot strap 18A is inhibited by the midfoot strap 18A when the second fastener 54A is secured to the first fastener 50A (i.e., when the distal segment 58A and a portion of the proximal segment 56A are secured to the first fastener 50A) because the substantially inelastic second fastener 54A is snug against the body 30, supporting the arch of the inserted foot 16, as is evident from the position of the midfoot strap 18A in FIG. 3. Once the strap 18A is secured to the first fastener 50A, the exposed portion 59A, is locked out from additional stretching (i.e., additional stretching is inhibited) because it is between the secured proximal segment 56A and the secured distal segment 58A, both of which are locked in position on the first fastener 50A.

The anchored end 32A of the midfoot strap 18A is at least partially forward of the first fastener 50A such that the midfoot strap 18A angles rearward from the anchored end 32A on the medial side 26 to the distal end 42A on the lateral side 28 when the second fastener 54A is secured to the first fastener 50A. This aids in strapping the foot 16 both back (rearward) and down within the upper 12.

While the midfoot strap 18A is configured and functions as described to secure the foot 16 relative to the midfoot portion 12B of the upper 12 and the sole structure 34, the forefoot strap 18B is configured and functions in a substantially identical manner to secure the foot 16 relative to the forefoot portion 12A of the upper 12 and the sole structure 24. The forefoot strap 18B is also referred to herein as an additional strap, and is selectively securable to and releasable from the additional first fastener 50B independently from the position of the midfoot strap 18A relative to the upper 12. The forefoot strap 18B has an anchored end 32B fixed adjacent the medial side 26 of the body 30. The anchored end 32B is also referred to as a fixed end. More specifically, as shown in FIG. 3, the anchored end 32B is attached to the sole structure 34 between the midsole 40 and the outsole 38. The anchored end 32B is laterally outward of the midsole 40, and the outsole 38 is laterally outward of the anchored end 32B. The anchored end 32B is disposed such that it is sandwiched between the midsole 40 and the outsole 38.

The forefoot strap 18B has a distal end 42B selectively remote from the upper 12. The distal end 42B may also be referred to as a "free end" as it is freely movable when not secured to the upper 12. FIGS. 5 and 6 show the distal end 42B remote from the upper 12. FIGS. 1, 2, and 7 show the distal end 42B selectively secured to the upper 12 via the fasteners described herein. The forefoot strap 18B has an inner side 44B best shown in FIG. 6 and an outer side 46B best shown in FIG. 7, which may also be referred to as an inner surface 44B or inner face 44B and an outer surface 46B or outer face 46B, respectively. When the distal end 42B is selectively secured to the upper 12, the inner side 44B faces the outer surface 48 of the body 30 and the outer side 46B faces outward, away from the outer surface 48.

As best shown in FIGS. 4 and 6, a first fastener 50B is fixed to the outer surface 48 of the body 30 on the lateral side 28 of the upper 12. The first fastener 50B is referred to herein as an additional first fastener, and extends generally from an uppermost extent of the upper 12 over the top of the forefoot portion 12A and over the midsole 40. Similar to the distal end 42B of the forefoot strap 18B, a distal end 52B of the first fastener 50B may be fixed to the sole structure 34, and sandwiched between the midsole 40 and the outsole 38 as shown in FIG. 4. The first fastener 50B is less elastic than the body 30. In the embodiment shown, the first fastener 50B is substantially inelastic. In one non-limiting example, the elastic stretchability of the first fastener 50B is less than or equal to about 5% elongation when the first fastener 50B is pulled along its length with 40 kilograms force at 500 millimeters per minute loading rate. Accordingly, elastic stretchability of the body 30 at the first fastener 50B is inhibited by the less elastic first fastener 50B overlying and fixed to the body 30. The first fastener 50B inhibits stretching of the upper 12 at the first fastener 50B.

An additional segmented second fastener 54B is fixed to the inner side 44B of the forefoot strap 18B as best shown in FIGS. 5 and 6. The segmented second fastener 54B is referred to as segmented because it includes a proximal segment 56B and a distal segment 58B. The distal segment 58B is closer to the distal end 42B of the forefoot strap 18B than is the proximal segment 56B. The distal segment 58B is spaced apart from the proximal segment 56B along the inner side 44B of the forefoot strap 18B such that an exposed portion 59B of the inner side 44B of the forefoot strap 18B is between a distal edge 57E of the proximal segment 56B and a proximal edge 57G of the distal segment 58B. The proximal segment 56B of the strap 18B has a first end 57F and has a second end 57E (also referred to as the distal edge 57E). The distal segment 58B has a first end 57G (also referred to as the proximal edge 57G) and has a second end 57H. The exposed portion 59B is between the second end 57E of the proximal segment 56B and the first end 57G of the distal segment 58B. The second end 57E of the proximal segment 56B and the first end 57G of the distal segment 58B are non-linear so that the exposed portion 59B is chevron-shaped. The segmented second fastener 54B is less elastic than the forefoot strap 18B. In the embodiment shown, the segmented second fastener 54B is substantially inelastic. In one non-limiting example, the elastic stretchability of either segment of the second fastener 54B is less than or equal to about 5% elongation when the second fastener 54B is pulled along its length with 40 kilograms force at 500 millimeters per minute loading rate. Elastic stretchability of the forefoot strap 18B at the second fastener 54B is inhibited by the second fastener 54B on portions of the forefoot strap 18B where the second fastener 54B is fixed to the forefoot strap 18B. Stated differently, the segmented second fastener 54B inhibits stretching of the forefoot strap 18B lengthwise except at the exposed portion 59B. Elastic stretchability of the forefoot strap 18B at the exposed portion 59B of the forefoot strap 18B is that of the material of the forefoot strap 18B, and is not inhibited by the second fastener 54B as it is not overlain by or fixed to the second fastener 54B. Elastic stretchability of the forefoot strap 18B at the exposed portion 59B is thus greater than elastic stretchability of the forefoot strap 18B at the second fastener 54B (i.e., at the portions of the forefoot strap 18B to which the distal segment 58B and proximal segment 56B are fixed). In one non-limiting example, the elastic stretchability of the forefoot strap 18B at the exposed portion 59B may be greater than or equal to about 20% elongation when the forefoot strap 18B is pulled along its length with 40 kilograms force at 500 millimeters per minute loading rate.

Accordingly, sufficient tensile force applied along the length of the forefoot strap 18B will cause the forefoot strap 18B to stretch in tension at the exposed portion 59B, while the less elastic proximal segment 56B and the distal segment 58B inhibit (i.e., lockout) stretch of the forefoot strap 18B at portions of the forefoot strap 18B to which the segmented second fastener 54B is fixed.

In one embodiment, the first and second fasteners 50B, 54B are hook-and-loop fastener material. One of the first fastener 50B and the second fastener 54B is a plurality of loops and the other one of the first fastener 50B and the second fastener 54B is a plurality of hooks configured to engage with the plurality of loops when the second fastener 54B contacts the first fastener 50B, such as when the second fastener 54B is pressed against the first fastener 50B. In the embodiments shown, the first fastener 50B is a plurality of loops 60, and the second fastener 54B is a plurality of hooks 62 as shown in FIG. 8. In another embodiment, the first fastener 50B could be a plurality of hooks, and the second fastener 54B could be a plurality of loops. The first fastener 50B may thus be referred to as an additional first strip of hook-and-loop fastener material, the proximal portion 56B of the second fastener 54B may be referred to as an additional second strip of hook-and-loop fastener material, and the distal portion 58B of the second fastener 54B may be referred to as an additional third strip of hook-and-loop fastener material. In other embodiments, the plurality of hooks can include a stem with a double-pronged end, or any of the mechanical interlocking fastening systems or magnetic fastening systems as described with respect to fasteners 50A, 54A.

The forefoot strap 18B is configured such that the distal end 42B of the forefoot strap 18B crosses over the body 30 from the medial side 26 to the lateral side 28 and the distal segment 58B secures to the first fastener 50B, as best shown in movement of the distal end 42B of the forefoot strap 18B in the direction of arrow C from the unsecured position of FIG. 6 to the secured positon of FIG. 7. The forefoot strap 18B overlies the forefoot portion 12A of the upper 12 and the second fastener 54B secures to the first fastener 50B by the hooks 62 and loops 60 of the fasteners 50B, 54B engaging when the second fastener 54B overlies and presses against the first fastener 50B. Stated differently, the proximal segment 56B overlies the body 30 on the medial side 26 and partly overlies the first fastener 50B, and the distal segment 58B overlies the first fastener 50B. The forefoot strap 18B releases from the first fastener 50B when the distal end 42B of the forefoot strap 18B is pulled away from the upper 12, such as by peeling the distal end 42B in the direction of arrow D in FIG. 7, to release the engaged hooks 62 and loops 60 of the fasteners 50B, 54B.

In the secured position of FIG. 7, the inner side 44B of the forefoot strap 18B faces the outer surface 48 of the upper 12, and the proximal segment 56B is held against the body 30 on the medial side 26 of the upper 12. The forefoot strap 18B elastically stretches mainly at the exposed portion 59B when pulled in tension and pressed toward the upper 12 so that the second fastener 54B secures to the first fastener 50B, causing the forefoot strap 18B to remain extended in tension when in the secured position of FIG. 2. The proximal segment 56B extends from the anchored end 32B to the exposed portion 59B. As shown in FIGS. 2 and 7, the proximal segment 56B has a length sufficient such that a portion of the proximal segment 56B nearest the exposed portion 59B is also secured to the first fastener 50B when the distal segment 58B is secured to the first fastener 50B.

Elastic stretchability of the upper 12 on the medial side 26 is that of the material of the body 30 when the second fastener 54B is remote from the first fastener 50B as the body 30 is unrestrained by the forefoot strap 18B when the segmented second fastener 54B is remote from the upper 12, such as shown in FIG. 5. This allows the upper 12 to stretch during insertion of the foot 16. Elastic stretchability of the upper 12 is inhibited by the forefoot strap 18B when the segmented second fastener 54B is secured to the first fastener 50B (i.e., when the distal segment 58B and a portion of the proximal segment 56B are secured to the first fastener 50B). The forefoot strap 18B is held snugly against the body 30, crossing over and around the metatarsal-phalangeal joints of a foot within the upper 12, as shown in FIG. 3. Once the forefoot strap 18B is secured to the first fastener 50B, the exposed portion 59B is locked out from additional stretching (i.e., additional stretching is inhibited) because it is between the secured proximal segment 56B and secured distal segment 58B, both of which are locked in position on the first fastener 50B.

The anchored end 32B of the forefoot strap 18B is at least partially forward of the first fastener 50B such that the forefoot strap 18B angles rearward from the anchored end 32B on the medial side 26 to the distal end 42B on the lateral side 28 when the second fastener 54B is secured to the first fastener 50B as is apparent by the position of the forefoot strap 18B in FIG. 7. This aids in strapping the foot 16 both back (i.e., rearward) and down within the upper 12.

Either prior to or after securing either or both of the midfoot strap 18A and the forefoot strap 18B to the upper 12 via the first fasteners 50A, 50B as described, the ankle of the wearer can be secured in the ankle portion 12D of the upper 12 via the third strap 20, also referred to herein as an ankle strap. The ankle is represented by the extended phantom lines of the foot 16. An additional fastener 50C is fixed to the lateral side 28 of the body 30 in the ankle portion 20D. The ankle strap 20 has an anchored end 32C secured to the ankle portion 20D of the body 30 and has a distal end 42C selectively remote from the upper 12. The ankle strap 20 has an inner side 44C best seen in FIG. 5 and an outer side 46C best seen in FIG. 3. Another additional fastener 54C is secured to the inner side 44C of the ankle strap 20 and secures to the additional fastener 50C with the ankle strap 20 wrapping around the ankle portion 12D of the upper 12 from the medial side 26 of the upper 12 to the lateral side 28 of the upper 12. Stated differently, by pulling the distal end 42C of the ankle strap 20 around to the lateral side 28 and pressing the fastener 54C into contact with the first fastener 50C, the distal end 42C of the ankle strap 20 is secured to the upper 12. By pulling the distal end 42C back toward the medial side 26, the distal end 42C is releasable from the upper 12 and the ankle strap 20 is in an unsecured position.

Figure 9:
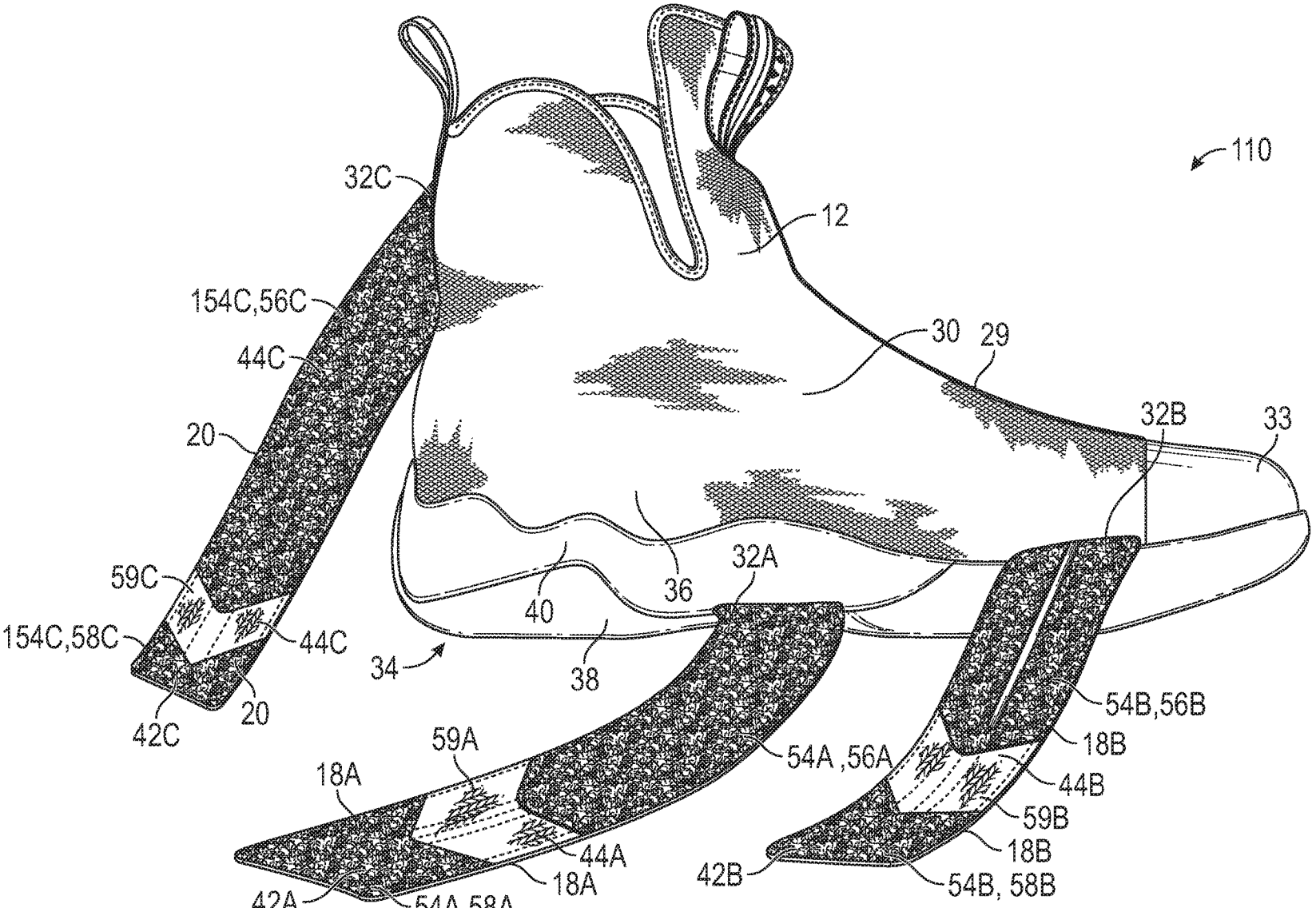
FIG. 9 is a schematic illustration in side view of the medial side of an alternative embodiment of an article of footwear with a forefoot strap, a midfoot strap and an ankle strap in an unsecured position.
Figure 10:
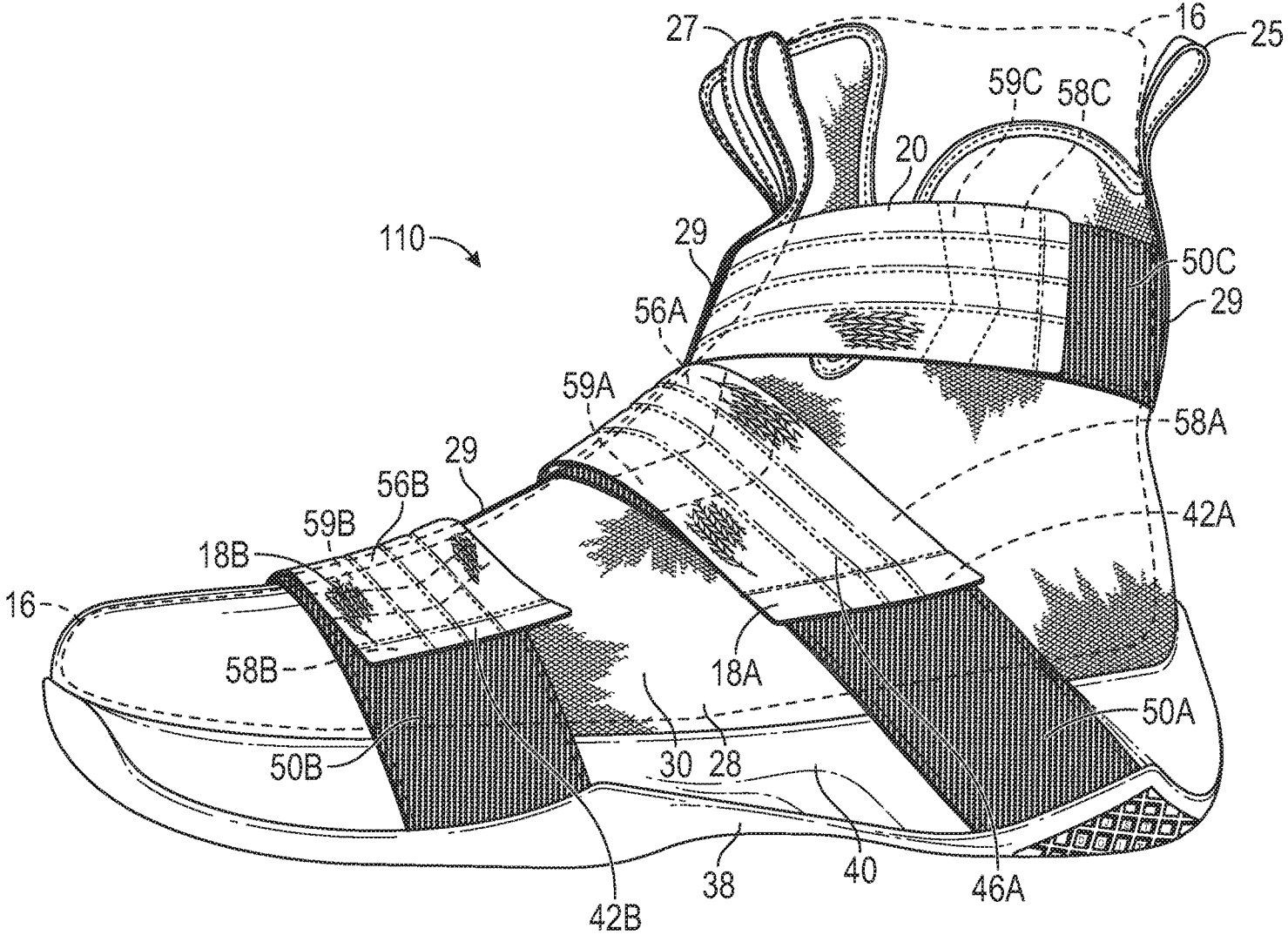
FIG. 10 is a schematic illustration in side view of a lateral side of the article of footwear of FIG. 9.

The additional fastener 54C on the ankle strap 20 of the article of footwear 10 is not a segmented fastener. However, the ankle strap 20 could have a segmented fastener, such as segmented additional fastener 154C as shown in the alternative embodiment of an article of footwear 110 of FIGS. 9 and 10. The additional fastener 154C is secured to the ankle strap 20, and is a segmented fastener with a distal segment 58C and a proximal segment 56C. The distal segment 58C is spaced apart from the proximal segment 56C so that the second fastener 154C does not overlap and is not fixed to an exposed portion 59C of the strap 20 between the segments 56C, 58C. Similar to the segmented second fasteners 54A and 54B, the segmented additional fastener 154C is substantially inelastic. In one non-limiting example, the elastic stretchability of either segment of the additional fastener 154C is less than or equal to about 5% elongation when the additional fastener 154C is pulled along its length with 40 kilograms force at 500 millimeters per minute loading rate. The strap 20 stretches at the exposed portion 59C when stretched in tension to secure to the first fastener 50C, but once secured to the first fastener 50C, the exposed portion 59C is locked out from additional stretching (i.e., additional stretching is inhibited) because it is between the secured proximal segment 56C and the secured distal segment 58C, both of which are locked in position on the first fastener 50C. In one non-limiting example, the elastic stretchability of the strap 20 at the exposed portion 59C may be greater than or equal to about 20% elongation when the strap 20 is pulled along its length with 40 kilograms force at 500 millimeters per minute loading rate.

Although the laceless fastening system 14 described herein has three straps 18A, 18B, and 20, a fastening system that uses only one of the straps 18A, 18B or both of straps 18A, 18B is included within the scope of the present teachings, and affords the adjustable fit, ease of foot insertion, and one-handed motion to secure the fastening system 14, locking out the flexible, stretchable body 30 of the upper 12 to thereby fix the position of the foot relative to the footwear 10 during all foot movements.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

an upper having a body with a first side and a second side;

a sole structure attached to a lower portion of the upper;

a laceless fastening system including:

a strap having an anchored end fixed adjacent to the second side of the body and having a distal end selectively remote from the upper; wherein the anchored end of the strap is fixed to sole structure; wherein the strap has an inner side and an outer side;

a first fastener fixed to an outer surface of the body on the first side; wherein the first fastener is less elastic than the body;

a segmented second fastener fixed to the inner side of the strap and configured to secure to the first fastener;

wherein the segmented second fastener includes a proximal segment and a distal segment each selectively remote from the upper and each covering a different portion of the inner side of the strap, with the distal segment closer to the distal end of the strap than the proximal segment and spaced apart from the proximal segment along the strap; wherein the proximal segment has a first end and a second end, and the distal segment has a first end and a second end; wherein an exposed portion of the inner side of the strap is between the second end of the proximal segment and the first end of the distal segment; wherein the first end of the proximal segment is at the anchored end and the proximal segment extends from the anchored end to the exposed portion; wherein the segmented second fastener is less elastic than the strap; and wherein the strap crosses over the body from the second side to the first side, and the distal segment overlies and secures to the first fastener, with the inner side of the strap facing the outer surface of the body, and with the proximal segment against the body on the second side.

2. The article of footwear of claim 1, wherein:

the body includes a first base material;

elastic stretchability of the body at the first fastener is inhibited by the first fastener;

elastic stretchability of the body on the second side is that of the first base material with the second fastener remote from the first fastener and is inhibited by the strap with the second fastener secured to the first fastener; and elastic stretchability of the strap at the second fastener is inhibited by the second fastener such that elastic stretchability of the strap at the exposed portion of the strap is greater than elastic stretchability of the strap at the second fastener.

3. The article of footwear of claim 1, wherein the strap is elastically stretched at the exposed portion with the second fastener secured to the first fastener so that the strap is extended in tension.

4. The article of footwear of claim 1, wherein a portion of the proximal segment is secured to the first fastener with the distal segment secured to the first fastener.

5. The article of footwear of claim 1, wherein:

the first fastener inhibits stretching of the body at the first fastener; and the second fastener inhibits stretching of the strap at the second fastener.

6. The article of footwear of claim 1, wherein the second fastener secures to the first fastener with the distal end of the strap pressed toward the upper, and releases from the first fastener with the distal end of the strap pulled away from the upper.

7. The article of footwear of claim 1, wherein one of the first fastener and the second fastener is a plurality of loops, and the other one of the first fastener and the second fastener is a plurality of hooks that engages with the plurality of loops with the second fastener pressed against the first fastener.

8. The article of footwear of claim 1, wherein:

the first side is a lateral side of the upper and the second side is a medial side; and the anchored end of the strap is at least partially forward of the first fastener such that the strap extends rearward from the medial side to the lateral side with the second fastener secured to the first fastener.

9. The article of footwear of claim 1, wherein the strap extends over one of a forefoot portion of the body, a midfoot portion of the body, or an ankle portion of the body with the second fastener secured to the first fastener.

10. The article of footwear of claim 1, wherein the laceless fastening system further comprises:

an additional strap having an anchored end fixed adjacent to the second side of the body and having a distal end selectively remote from the upper; wherein the additional strap has an inner side and an outer side;

an additional first fastener fixed to the outer surface of the body on the first side; wherein the additional first fastener is less elastic than the body;

an additional segmented second fastener less elastic than the additional strap and fixed to the inner side of the additional strap; wherein the additional segmented second fastener includes a proximal segment and a distal segment each covering a different portion of the inner side of the additional strap, with the distal segment of the additional segmented second fastener closer to the distal end of the additional strap than the proximal segment of the additional segmented second fastener and spaced apart from the proximal segment along the additional strap; wherein the proximal segment of the additional segmented second fastener has a first end and a second end, and the distal segment of the additional segmented second fastener has a first end and a second end; wherein an exposed portion of the inner side of the additional strap is between the second end of the proximal segment of the additional segmented second fastener and the first end of the distal segment of the additional segmented second fastener; and wherein the additional strap crosses over the body from the second side to the first side and the distal segment of the additional segmented second fastener secures to the additional first fastener, with the inner side of the additional strap facing the outer surface of the body, and with the proximal segment of the additional segmented second fastener against the body on the second side.

11. The article of footwear of claim 10, wherein the body has an ankle portion, and the laceless fastening system further comprises:

an additional fastener fixed to the ankle portion of the body at the first side of the body;

a third strap having an anchored end fixed to the ankle portion and having a distal end selectively remote from the upper; wherein the third strap has an inner side and an outer side; and another additional fastener fixed to the inner side of the third strap and that secures to the additional fastener with the third strap wrapping around the ankle portion of the upper from the second side to the first side.

12. The article of footwear of claim 1, wherein:

the sole structure includes:

an outsole; and a midsole attached to the outsole between the upper and the outsole; and the anchored end of the strap is disposed between the midsole and the outsole.

13. The article of footwear of claim 12, wherein:

an end of the first fastener is secured to the sole structure and disposed between the midsole and the outsole.

14. The article of footwear of claim 1, wherein the strap is a knit material.

15. The article of footwear of claim 1, wherein the body is unrestrained by the strap with the segmented second fastener remote from the first fastener.

16. The article of footwear of claim 1, wherein the second end of the proximal segment and the first end of the distal segment are non-linear.

17. The article of footwear of claim 16, wherein the exposed portion is chevron-shaped.

18. An article of footwear comprising: an upper having an elastic body and forming a cavity configured to receive a foot;

a laceless fastening system for securing the body around the foot including:

a first fastener comprising a first strip of hook-and-loop fastener material secured to a lateral side of the body; a strap having a fixed end fixed adjacent to a medial side of the body, and having a free end selectively remote from the upper; a second fastener configured to secure to the first fastener by contact with the first fastener, and the second fastener including: a second strip of hook-and-loop fastener material secured to an inner face of the strap at an expanse selectively remote from the upper, the second strip having a first end and a second end; and a third strip of hook-and-loop fastener material secured to the inner face of the strap at the expanse selectively remote from the upper, nearer to the free end than the second strip, and spaced apart from the second strip along the inner face of the strap, the third strip having a first end and a second end, with the inner face of the strap exposed between the second end of the second strip and the first end of the third strip; wherein: the second strip and the third strip are both either a plurality of hooks or a plurality of loops securable to a plurality of hooks, and the first strip is the other of the plurality of hooks and the plurality of loops; the strap wraps over and across the upper to the lateral side with the inner face of the strap facing the upper, with the second strip overlying the body of the upper on the medial side and partly overlying the first strip, and with the third strip overlying the first strip; and the second strip and the third strip secure to the first strip with the strap stretching in tension between the second strip and the third strip; a sole structure attached to a lower portion of the upper; wherein the fixed end of the strap is fixed to sole structure; and wherein the first end of the second strip is at the fixed end of the amp.

19. The article of footwear of claim 18, wherein:

the body includes a base material;

the strap is a first strap and overlies a midfoot portion of the body to support an arch of a foot received in the cavity with the third strip secured to the first strip;

the laceless fastening system further includes:

an additional first strip of hook-and-loop fastener material secured to a lateral side of the body forward of the first strip;

a second strap spaced forward of the first strap and having a fixed end fixed adjacent to the medial side of the body and having a free end selectively remote from the upper;

an additional second strip of hook-and-loop fastener material secured to an inner face of the second strap;

an additional third strip of hook-and-loop fastener material secured to the inner face of the second strap nearer the free end of the second strap than the additional second strip and spaced apart from the additional second strip along the inner face of the second strap;

the additional second strip and the additional third strip are both a plurality of hooks or a plurality of loops securable to a plurality of hooks, and the additional first strip is the other one of the plurality of hooks and the plurality of loops;

the second strap wraps over and across the upper to the lateral side with the inner face of the second strap facing the upper, with the additional second strip overlying the base material on the medial side and partly overlying the additional first strip, and with the additional third strip overlying the additional first strip; and the additional second strip and the additional third strip secure to the additional first strip with the second strap stretching in tension between the additional second strip and the additional third strip, and the second strap overlying a forefoot portion of the body on the medial side.

* * * * *